US009522555B2

(12) United States Patent
Hatakeyama

(10) Patent No.: US 9,522,555 B2
(45) Date of Patent: Dec. 20, 2016

(54) CONTROL SYSTEM AND IMAGE FORMING SYSTEM

(71) Applicant: Brother Kogyo Kabushiki Kaisha, Nagoya-shi, Aichi-ken (JP)

(72) Inventor: Yuichi Hatakeyama, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/065,957

(22) Filed: Mar. 10, 2016

(65) Prior Publication Data

US 2016/0288549 A1 Oct. 6, 2016

(30) Foreign Application Priority Data

Mar. 31, 2015 (JP) ..... 2015-074175

(51) Int. Cl.
*B41J 19/20* (2006.01)
*B41J 29/38* (2006.01)
*B41J 25/00* (2006.01)

(52) U.S. Cl.
CPC ..... *B41J 25/001* (2013.01)

(58) Field of Classification Search
CPC ..... B41J 19/202; B41J 25/001; B41J 29/38; H02P 23/20
See application file for complete search history.

(56) References Cited

U.S. PATENT DOCUMENTS 6,809,489 B1 * 10/2004 Yoshida ..... B41J 19/202 318/560
7,868,568 B2 * 1/2011 Iesaki ..... B41J 19/202 318/280
8,248,008 B2 * 8/2012 Iesaki ..... B41J 29/38 318/400.04
8,587,236 B2 * 11/2013 Iesaki ..... G05B 13/024 318/400.22
2005/0057200 A1 3/2005 Akiyama
2007/0166016 A1 7/2007 Iesaki
2008/0204491 A1 8/2008 Iesaki

FOREIGN PATENT DOCUMENTS

JP 2005-094857 A 4/2005
JP 2007-189876 A 7/2007
JP 2008-219962 A 9/2008

* cited by examiner

*Primary Examiner* — Ahn T. N. Vo
(74) *Attorney, Agent, or Firm* — Banner & Witcoff, Ltd.

(57) ABSTRACT

A control system includes: a motor; a driving unit including a driving target and displacing the driving target in a first direction and a second direction opposite to the first direction by transmitting power from the motor to the driving target; a detection unit detecting a position of the driving target; and a controller controlling the motor. The controller is configured to execute: a displacement control process to displace the driving target in the first direction and the second direction; a determination process to determine a holding current value holding the driving target at a target stop position; and a holding control process to hold the driving target, which has been disposed at the target stop position in the displacement control process, at the target stop position based on the holding current value determined by the determination process.

14 Claims, 17 Drawing Sheets

CONTROL SYSTEM AND IMAGE FORMING SYSTEM

CROSS REFERENCE TO RELATED APPLICATION

The present application claims priority from Japanese Patent Application No. 2015-074175 filed on Mar. 31, 2015, the disclosure of which is incorporated herein by reference in its entirety.

BACKGROUND

Field of the Invention

The present invention relates to a control system and an image forming system.

Description of the Related Art

There are conventionally known ink-jet image forming systems. For example, typical ink-jet image forming systems form an image on a sheet, which moves below an ink-jet head discharging ink droplets in a sub-scanning direction, during a process in which a carriage carrying the ink-jet head moves in a main scanning direction.

This type of image forming system includes, for example, a capping unit at an end or terminal (home position) of a carriage movement path. The capping unit is configured to cover a nozzle surface of the ink-jet head with a cap. The capping unit is configured, for example, as follows. Namely, when the carriage goes into the end of the carriage movement path, the capping unit moves the cap upward toward the nozzle surface upon receiving action of force from the carriage, and when the carriage is separated from the end of the carriage movement path, the capping unit moves the cap along with the movement of the carriage so that the cap is separated from the nozzle surface.

Further, typical ink-jet image forming systems include an image forming system as follows. Namely, in order to dispose the carriage at a target stop position, the carriage is finely moved in the vicinity of the target stop position. This fine movement is performed, for example, such that a driving current, which is to be inputted to a motor driving the carriage, is gradually changed and the driving current is returned to an initial value every time the carriage moves.

SUMMARY

In order to dispose and hold the carriage at the target stop position in a state of receiving the action of power from the capping unit, the right amount of driving current is required to be constantly inputted to the motor. For example, when a flushing operation of the ink-jet head is performed, the carriage is required to be disposed at a position where the cap is slightly separated from the ink-jet head. This position is not the end of the carriage movement path, and thus the carriage moves when the driving current has shortage or surplus.

Thus, such conventional image forming systems have the following problem. Namely, when the driving current has shortage or surplus, a phenomenon such as vibration occurs and the carriage moves from the target stop position. The vibration changes force acting on the carriage such as static frictional force, thereby moving the carriage. Note that this problem is not limited to the conventional image forming apparatuses. Similar to the image forming systems described above, when the force, which is not related to power from the motor, acts on a driving target of any other type of image forming apparatus, it is difficult to control the motor so that the driving target is held at the target stop position.

In view of the above, an object of the present teaching is to provide a system which is configured to control a driving current to appropriately hold a driving target at a target stop position.

A control system according to an aspect of the present teaching includes a motor, a driving unit, a detection unit, and a controller. The driving unit includes a driving target and displaces or moves the driving target in a first direction and a second direction opposite to the first direction by transmitting power from the motor to the driving target. The detection unit detects a position of the driving target. The controller controls the motor.

The controller is configured to execute a displacement control process, a determination process, and a holding control process. In the displacement control process, the controller controls an input current for the motor to displace the driving target in the first direction and the second direction. In the determination process, the controller determines a holding current value holding the driving target at a target stop position in the holding control process, the controller controls the input current for the motor based on the holding current value determined by the determination process to hold the driving target, which has been disposed at the target stop position in the displacement control process, at the target stop position.

In the displacement control process, when the driving target is displaced in the first direction, the controller may gradually change a first initial value of the input current so that the power acting on the driving target increases in the first direction every time the position of the driving target detected by the detection unit is displaced in the first direction.

In the displacement control process, when the driving target is displaced in the second direction, the controller may gradually change a second initial value of the input current so that the power acting on the driving target increases in the second direction every time the position of the driving target detected by the detection unit is displaced in the second direction.

In the determination process, the controller may determine the holding current value based on a first current value and a second current value. The first current value may be a value of the input current which is controlled in the displacement control process, in which the driving target passes a target area including the target stop position in the first direction, to change the position of the driving target in the first direction. The second current value may be a value of the input current which is controlled in the displacement control process, in which the driving target passes the target area in the second direction, to change the position of the driving target in the second direction.

The first current value corresponds to a current value which is required to displace the driving target in the first direction near the target stop position. The second current value corresponds to a current value which is required to displace the driving target in the second direction near the target stop position. Thus, a current value, which can stably hold the driving target while preventing the influence due to an external factor such as vibration, can be approximately specified based on the first current value and the second current value.

As described above, it is possible for the aspect of the present teaching to build the control system which can appropriately hold the driving target at the target stop position. Specifically, the holding current value may be determined to a value between the first current value and the second current value. For example, the holding current value may be determined to an average value of the first current value and the second current value. Determining the holding current value to the average value of the first current value and the second current value allows the driving target to be held at the target stop position more stably.

DESCRIPTION OF THE EMBODIMENTS

Hereinbelow, an explanation will be made about embodiments of the present teaching with reference to drawings.

First Embodiment

Figure 1:
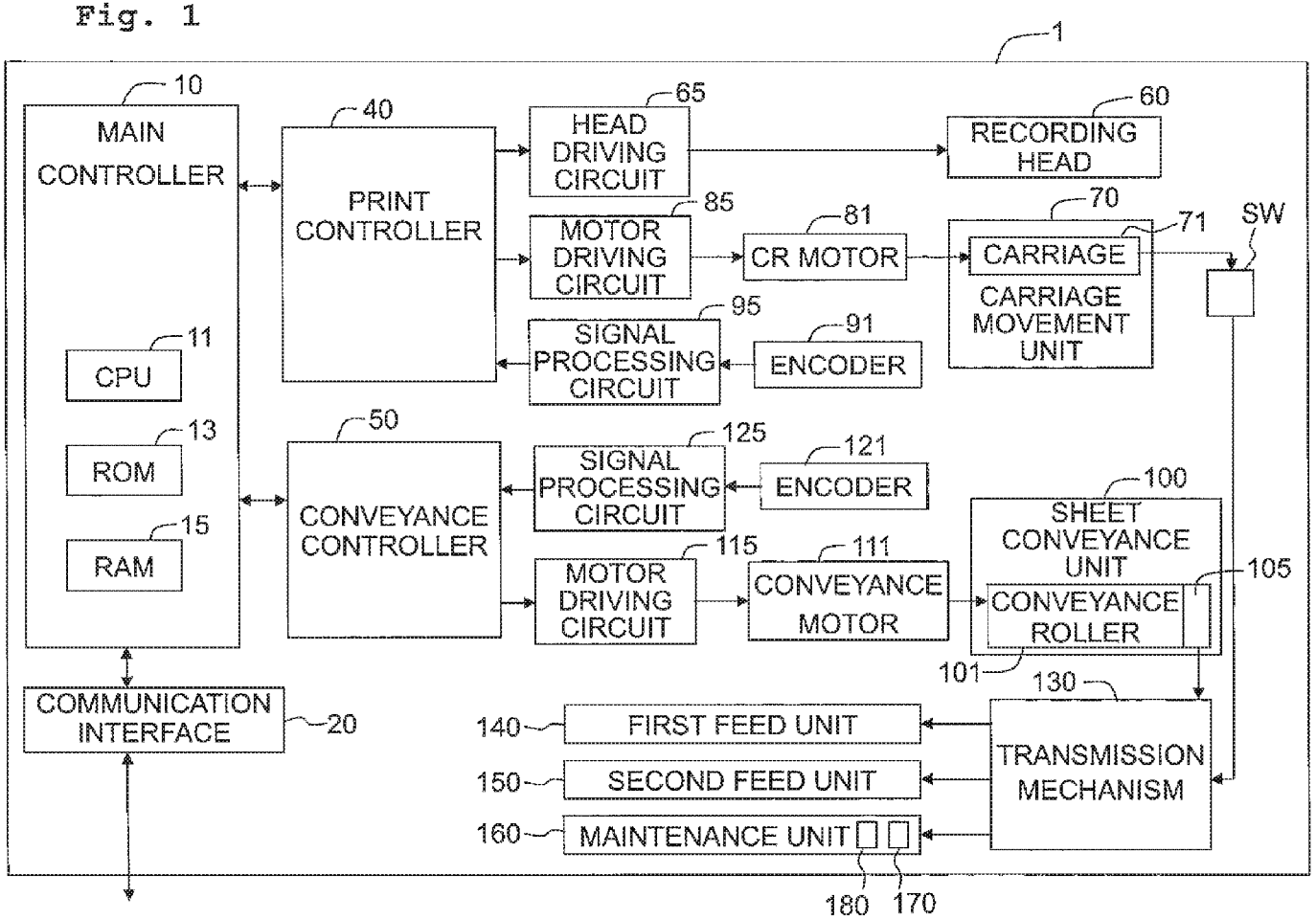
FIG. 1 is a block diagram of a configuration of an image forming system.

An image forming system 1 of the first embodiment depicted in FIG. 1 is configured as an ink-jet printer. The image forming system 1 includes a main controller 10, a communication interface 20, a print controller 40, and a conveyance controller 50.

The main controller 10 includes a CPU 11, a ROM 13, and a RAM 15. Various programs are stored in the ROM 13. The CPU 11 performs processes in accordance with these programs. The RAM 15 is used as a work area when the CPU 11 performs each of the processes. The CPU 11 executes processes in accordance with the programs stored in the ROM 13 to integrally control respective parts of the system, thereby achieving various functions. The communication interface 20 is configured to perform data communication with an external apparatus.

The print controller 40 is configured to perform an image forming operation on a sheet Q by controlling movement of a carriage 71 (see FIG. 2) carrying a recording head 60 and a discharge operation of ink droplets performed by the recording head 60 in accordance with a command from the main controller 10. The components, of the image forming system 1, relating to the image forming operation include the recording head 60, a head driving circuit 65, a carriage movement unit 70, a CR motor 81, a motor driving circuit 85, an encoder 91, and a signal processing circuit 95.

The recording head 60 is an ink-jet head which discharges ink droplets to the sheet Q. The head driving circuit 65 drives the recording head 60 in accordance with an input signal from the print controller 40. The carriage movement unit 70 transmits power from the CR motor 81 to the carriage 71, thereby causing the carriage 71 to reciprocate in a main scanning direction.

The CR motor 81 is formed of a direct current (DC) motor. The motor driving circuit 85 drives the CR motor 81 by PWM control. Specifically, the motor driving circuit 85 inputs a driving current, which corresponds to an operation amount U inputted from the print controller 40, to the CR motor 81, and then drives the CR motor 81 so that the CR motor 81 generates power (torque) corresponding to the operation amount U. The DC motor has a proportional relation between the driving current and the power (torque) generated by the driving current. The operation amount U inputted from the print controller 40 to the motor driving circuit 85 corresponds to an electric-current command value indicating the driving current to be inputted to the CR motor 81.

The encoder 91 is a linear encoder which outputs an encoder signal according to displacement or movement of the carriage 71 in the main scanning direction. The signal processing circuit 95 detects a position P of the carriage 71 in the main scanning direction based on the encoder signal inputted from the encoder 91. The position P of the carriage 71 detected by the signal processing circuit 95 is inputted to the print controller 40. The print controller 40 controls the CR motor 81 based on the position P of the carriage 71 detected by the signal processing circuit 95.

The conveyance controller 50 controls conveyance of the sheet Q by controlling a conveyance motor 111 in accordance with a command from the main controller 10. Further, the conveyance controller 50 controls the driving of a pump 170 of a maintenance unit 160. The components, of the image forming system 1, relating to conveyance of the sheet Q include a sheet conveyance unit 100, the conveyance motor 111, a motor driving circuit 115, an encoder 121, and a signal processing circuit 125.

The sheet conveyance unit 100 rotates a conveyance roller 101 upon receiving power from the conveyance motor 111, thereby conveying the sheet Q in a sub-scanning direction perpendicular to the main scanning direction. Accordingly, the sheet Q is conveyed to a position where the recording head 60 discharges ink droplets onto the sheet Q. The conveyance motor 111 is formed of the DC motor. The motor driving circuit 115 drives the conveyance motor 111 according to an operation amount inputted from the conveyance controller 50.

The encoder 121 is a rotary encoder which is disposed in the vicinity of a rotation shaft of the conveyance motor 111 or conveyance roller 101 to output an encoder signal according to rotation of the conveyance motor 111 or conveyance roller 101. The signal processing circuit 125 detects a rotation position and rotation velocity of the conveyance roller 101 based on the encoder signal inputted from the encoder 121.

The rotation position and rotation velocity detected by the signal processing circuit 125 are inputted to the conveyance controller 50. The conveyance controller 50 determines an operation amount for the conveyance motor 111 based on the rotation position and rotation velocity detected by the signal processing circuit 125, and controls the conveyance motor 111 based on the determined operation amount. The rotation of the conveyance roller 101 and the conveyance of the sheet Q are controlled, accordingly.

Figure 2:
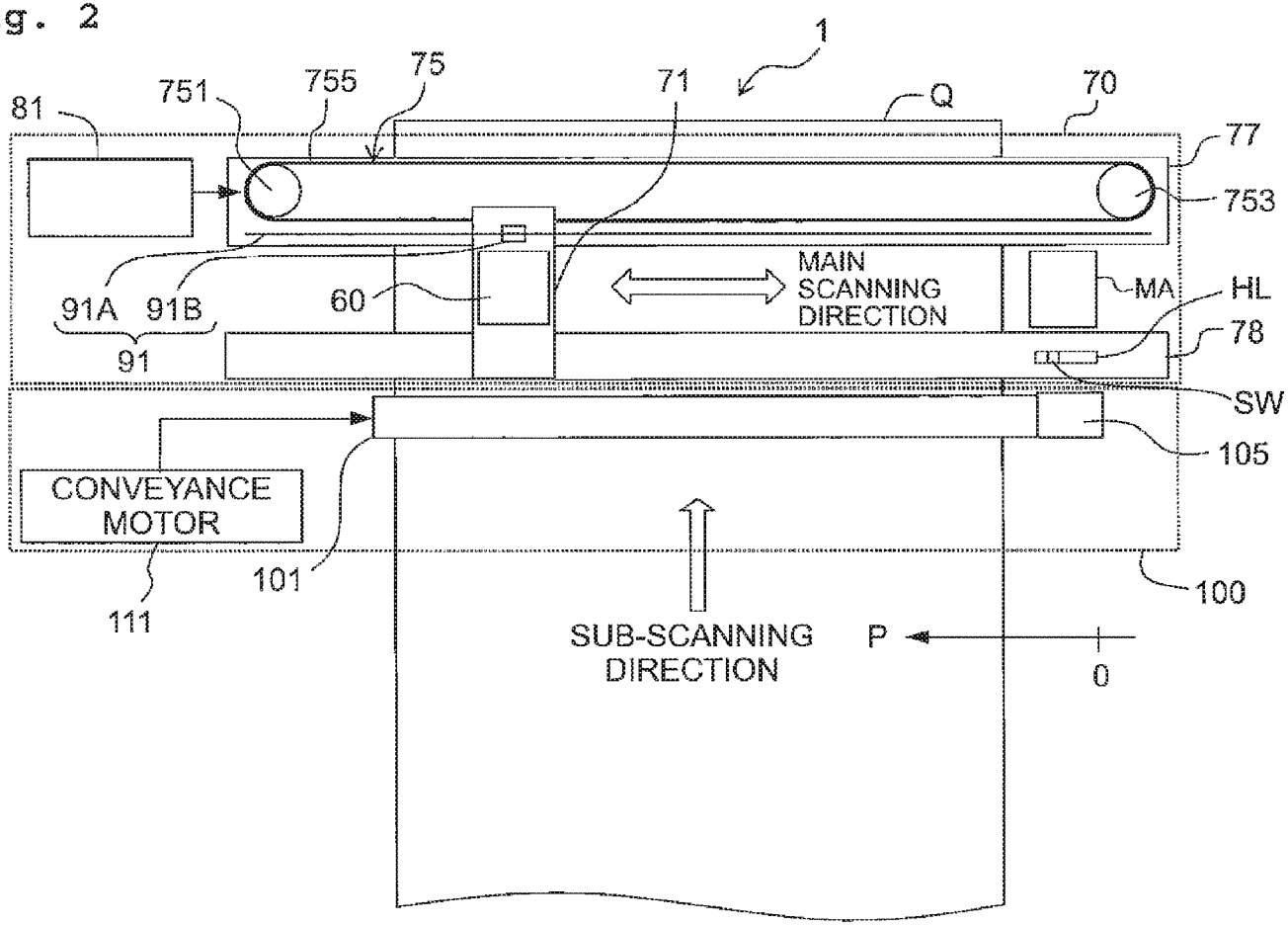
FIG. 2 is a top view of a mechanical configuration of a carriage movement unit.

A gear 105 meshing with a transmission mechanism 130 is fixed to an end of the conveyance roller 101 so that the gear 105 is integrated with the conveyance roller 101 (see FIG. 2). The transmission mechanism 130 of the image forming system 1 receives power generated from the conveyance motor 111 via the conveyance roller 101 and the gear 105 and transmits the power downstream. The image forming system 1 includes a first feed unit 140, a second feed unit 150, and the maintenance unit 160 which are installed downstream of a power transmission path.

The transmission mechanism 130 includes a lever SW, a movement gear, and other gears. The lever SW is operated by movement of the carriage 71. The movement gear constantly meshes with the gear 105 while moving along with movement of the lever SW. The transmission mechanism 130 generates a situation in which power from the conveyance roller 101 is transmitted to any one of the first feed unit 140, the second feed unit 150, and the maintenance unit 160 or a situation in which power from the conveyance roller 101 is not transmitted to all of the first feed unit 140, the second feed unit 150, and the maintenance unit 160, according to the position of the movement gear moving along with movement of the lever SW and the rotation direction of the conveyance motor 111.

Each of the first feed unit 140 and the second feed unit 150 includes an individual feed tray, and supplies the sheet Q accommodated in each of the feed trays to the conveyance roller 101 upon receiving power from the conveyance motor 111 which is transmitted via the conveyance roller 101, the gear 105, and the transmission mechanism 130.

The maintenance unit 160 performs maintenance of the recording head 60. The maintenance unit 160 includes the pump 170 and a capping unit 180. The pump 170 operates to suck the ink, which was discharged by the recording head 60 on a cap 181 (see FIG. 3) of the capping unit 180, upon receiving power from the conveyance motor 111 via the transmission mechanism 130.

Subsequently, an explanation will be made about the configuration of the carriage movement unit 70 in detail. As depicted in FIG. 2, the carriage movement unit 70 includes the carriage 71, a belt mechanism 75, and guide rails 77, 78.

The belt mechanism 75 includes a driving pulley 751, a driven pulley 753, and a belt 755. The driving pulley 751 and the driven pulley 753 are aligned in the main scanning direction. The belt 755 is wound around or stretched between the driving pulley 751 and the driven pulley 753. The carriage 71 is fixed to the belt 755. In the belt mechanism 75, the driving pulley 751 rotates upon receiving power from the CR motor 81 and the belt 755 and the driven pulley 753 are driven to rotate in association with rotation of the driving pulley 751.

The guide rails 77, 78 extend in the main scanning direction, and they are disposed to be separated from each other in the sub-scanning direction. The guide rail 78 has a hole HL. The lever SW protrudes the guide rail 78 from the lower side to the upper side (protrudes to reach the movement path of the carriage 71) through the hole HL. The lever SW moves toward the end or terminal of the carriage movement path (guide rail 78) by being pressed by the carriage 71. The lever SW is biased, within its movement area, by a spring in a direction in which the lever SW returns toward the center of the carriage movement path.

The belt mechanism 75 is disposed in the guide rail 77. The guide rails 77, 78 include, for example, convex walls (not depicted) extending in the main scanning direction. The convex walls regulate the movement direction of the carriage 71 to the main scanning direction. The carriage 71 is disposed on the guide rails 77, 78 so that, for example, grooves formed in the lower surface of the carriage 71 are engaged with the convex walls of the guide rails 77, 78. The carriage 71 disposed in this manner reciprocates over the guides rails 77, 78 in the main scanning direction while coordinating with rotation of the belt 755. The recording head 60 is carried on the carriage 71 to move in the main scanning direction along with movement of the carriage 71.

The position of the carriage 71 at the time of disposing the lever SW at the end or terminal of the movement area of the lever SW corresponds to a home position of the carriage 71. The home position corresponds to the end of the carriage movement path beyond which the carriage 71 does not move to the side of the end of the guide rail 78. In the following, a direction in which the carriage 71 moves from the end (i.e., home position) of the carriage movement path toward the center is to be referred to as a first direction, and a direction in which the carriage 71 moves toward the end of the carriage movement path is to be referred to as a second direction. Further, the position P of the carriage 71 detected by the signal processing circuit 95 is shown by a one-dimensional position coordinate system in which the end (i.e., home position) of the carriage movement path is an origin P=0 and the first direction is a positive direction.

The encoder 91 (see FIG. 1) includes an encoder scale 91A and an optical sensor 91B. The encoder scale 91A is disposed in the guide rail 77 along the main scanning direction. The optical sensor 91B is carried on the carriage 71. The encoder 91 outputs, to the signal processing circuit 95, an encoder signal according to the change in a relative position between the encoder scale 91A and the optical sensor 91B. The encoder signal is a pulse signal in which a signal edge is generated every time the optical sensor 91B moves relative to the encoder scale 91A by a predetermined amount. The signal processing circuit 95 detects the position P of the carriage 71 by counting the edge of the pulse signal (encoder signal) inputted from the encoder 91. The position P of the carriage 71 is shown by a value (the number of counts of the signal edge) of which unit is a distance corresponding to an edge generation interval of the pulse signal (encoder signal).

As depicted in FIG. 2, the conveyance roller 101 is disposed on the upstream side of the recording head 60 in the sub-scanning direction. The conveyance roller 101 rotates to feed or convey the sheet Q, which is conveyed from any of the feed units 140, 150, to the position where the recording head 60 discharges ink droplets. The capping unit 180 is provided in a maintenance area MA corresponding to an terminal area of the carriage movement path. The capping unit 180 moves the cap 181 depicted in FIG. 3 in an up-down direction according to movement of the carriage 71 in the maintenance area MA.

Figure 3:
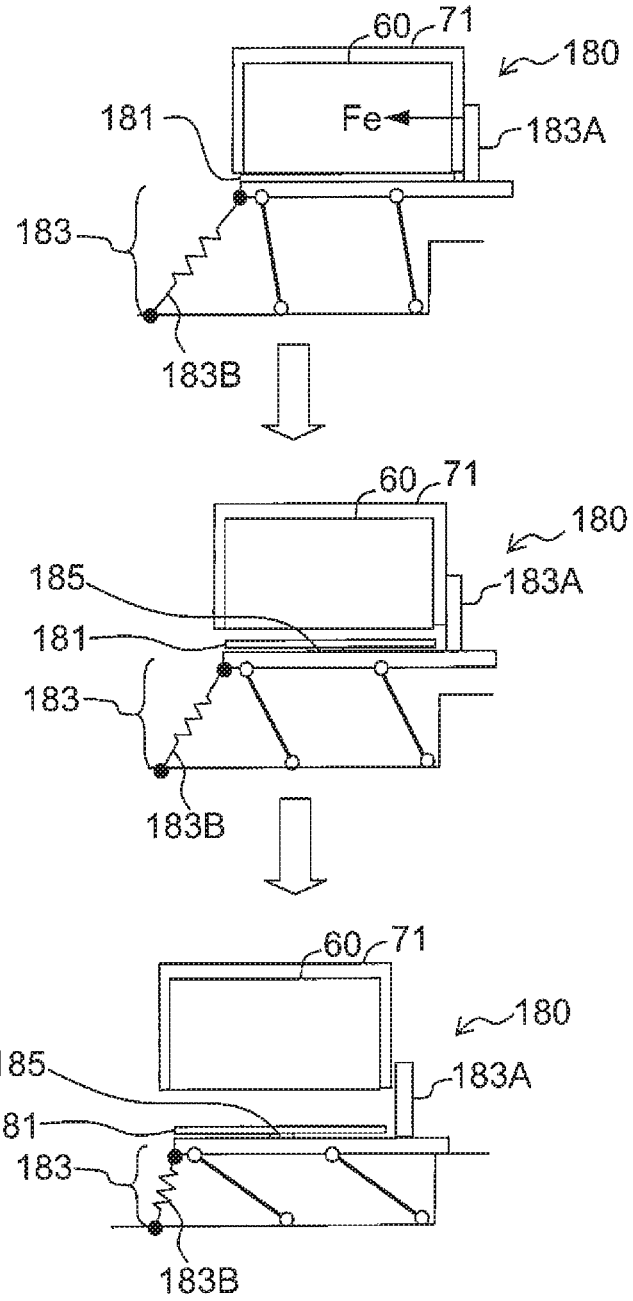
FIG. 3 depicts a mechanical configuration of a capping unit.

The capping unit 180 includes a lift 183 and the cap 181 covering the nozzle surface of the recording head 60 in which discharge ports of ink droplets are aligned. The cap 181 is connected to the lift 183 via a spring 185. FIG. 3 schematically depicts, on the uppermost side thereof, the arrangement of the cap 181 and the lift 183 in which the carriage 71 is positioned at the home position (i.e., the end of the carriage movement path) and the cap 181 is attached to recording head 60; FIG. 3 schematically depicts, in the center thereof, the arrangement of the cap 181 and the lift 183 in which the carriage 71 is slightly separated from the home position to approach the center of the carriage movement path and the cap 181 is removed from the recording head 60; and FIG. 3 schematically depicts, on the lowermost side thereof, the arrangement of the cap 181 and the lift 183 in which the carriage 71 is completely separated from the capping unit 180 and the cap 181 is disposed at the lowermost position.

The lift 183 includes a wall 183A making contact with the carriage 71. The lift 183 operates upon receiving the action of power from the carriage 71 in motion. Specifically, when the carriage 71 goes into the maintenance area MA from the central side of the carriage movement path so as to move to the end (i.e., home position) of the carriage movement path, the lift 183 moves the cap 181 upward gradually, upon receiving the action of power from the carriage 71 via, the wall 183A, to attach the cap 181 to the nozzle surface of the recording head 60. The attachment of the cap 181 is completed when the carriage 71 has reached the end of the carriage movement path.

When the carriage 71 is separated from the end (i.e., home position) of the carriage movement path, the lift 183 is released from the restraint brought about by the action of power from the carriage 71 to lower the cap 181 by the aid of the own weight of the cap 181 and the biasing power of a spring 183B provided for the lift 183. Lowering the cap 181 removes the cap 181 from the recording head 60. As understood from FIG. 3, the lift 183 receives the biasing power of the spring 183B in a direction of which components are the first direction and a downward direction.

Since the capping unit 180 is configured as described above, the carriage 71 in a state of making contact with the capping unit 180 receives the power Fe acting from the capping unit 180 in the first direction, as depicted in FIG. 3. Namely, the carriage 71 in a state of making contact with the capping unit 180 receives a load from the capping unit 180.

Figure 4:
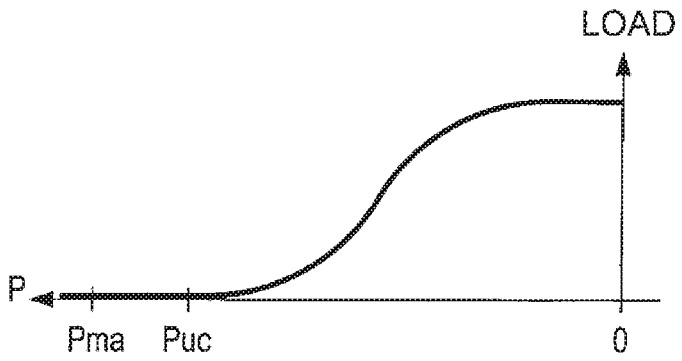
FIG. 4 is a graph showing a load fluctuation.

As shown in FIG. 4, this load has a tendency in which the load is high when the carriage 71 is disposed at the home position (P=0, that is, the end of the carriage movement path) and the load decreases with displacement of the carriage 71 from the home position in the first direction. In other words, when the carriage 71 goes into the maintenance area MA to move to the home position in the second direction, this load tends to increase with displacement of the carriage 71 in the second direction. A position Puc of the carriage 71 shown in FIG. 4 corresponds to a position Puc where the cap 181 has reached the lowermost position and the carriage 71 is not brought into contact with the capping unit 180. A position Pma of the carriage 71 shown in FIG. 4 corresponds to a starting point of the maintenance area MA.

In the maintenance area MA, the state of the capping unit 180 changes according to the position of the carriage 71. Further, the position of the lever SW changes according to the position of the carriage 71, thereby changing the state of the transmission mechanism 130. Thus, the carriage 71 is finely driven in the maintenance area MA to gradually move to a position where the image forming system 1 can perform a target operation. Accordingly, the carriage 71 is accurately disposed at a target position (target stop position).

After disposing the carriage 71 at the target stop position, the carriage 71 is required to be held at the target stop position in order to maintain the operation state, of the image forming system 1, taken when the carriage 71 is at the target stop position. Since the carriage 71 receives the load in the maintenance area MA, the right amount of driving current is required to be inputted to the CR motor 81 to hold the carriage 71 at the target stop position under such an environment. In the following, the driving current to be inputted to the CR motor 81 in order to hold the carriage 71 at the target stop position is to be referred to as a holding current.

In the maintenance area MA, however, the load changes according to the position of the carriage 71. Thus, when a certain amount of holding current is inputted to the CR motor 81 independent of the target stop position, the excess or shortage of holding current occurs.

When it is assumed that static frictional force in a state that the carriage 71 is in a stationary state is a value Fsf and that the load acting on the carriage 71 is a value Fe, the CR motor 81 is required to apply, to the carriage 71, the power ranging from—(Fsf+Fe) to—(−Fsf+Fe) in order to hold the carriage 71 in the stationary state. Here, like the position P, the magnitude of power is shown by defining the first direction as the positive direction.

Figure 5:
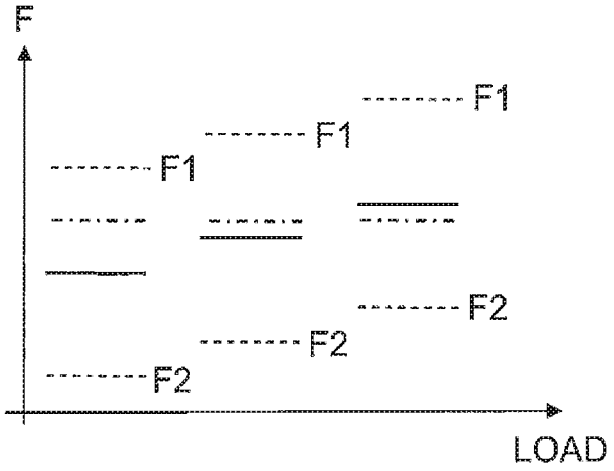
FIG. 5 is an illustrative view illustrating a range of power which is capable of holding a carriage in a stopped state.

Namely, in order to hold the carriage 71 at the target stop position, the CR motor 81 is required to apply, to the carriage 71, the power in a predetermined range which has an upper limit F1 (for example, the power corresponding to—(−Fsf+Fe)) and a lower limit F2 (for example, the power corresponding to—(Fsf+Fe)). The upper limit F1 and lower limit F2, however, vary according to the load, as shown in FIG. 5. Thus, when a holding current value in the maintenance area MA is uniform, the power from the CR motor 81 to the carriage 71 may be deviated from the center of the range ranging from the upper limit F1 to the lower limit F2. The dot-and-dash lines in FIG. 5 each show the magnitude of power from the CR motor 81 to the carriage 71 applied when the holding current value is uniform, and the magnitude of power is schematically shown by a relative relation between the upper limit F1 and the lower limit F2.

When the holding current causes the power from the CR motor 81 to the carriage 71 to be closer to the upper limit or lower limit of the above range than to the center thereof, static frictional force and/or external force acting on the carriage 71 may change due to vibration or the like caused in the image forming system 1. In this case, the balance of power is lost, and thus the carriage 71 is more likely to move from the target stop position. Namely, the carriage 71 is less likely to be held at the target stop position as the holding current value is deviated further from the center of the above power range ranging from the upper limit F1 to the lower limit F2 (i.e., as the power acting on the carriage 71 is closer to the upper limit F1 or the lower limit F2 of the above range than to the center thereof).

In view of the above, in this embodiment, the holding current value is changed according to the target stop position so that the power corresponding to the holding current is at the center of the range ranging from the upper limit F1 to the lower limit F2. The bold lines in FIG. 5 each show the magnitude of power which corresponds to a holding current value obtained when the holding current value is changed according to the target stop position. In the following, the configuration of the image forming system 1 relating to the change of the holding current value will be explained in detail.

Figure 6:
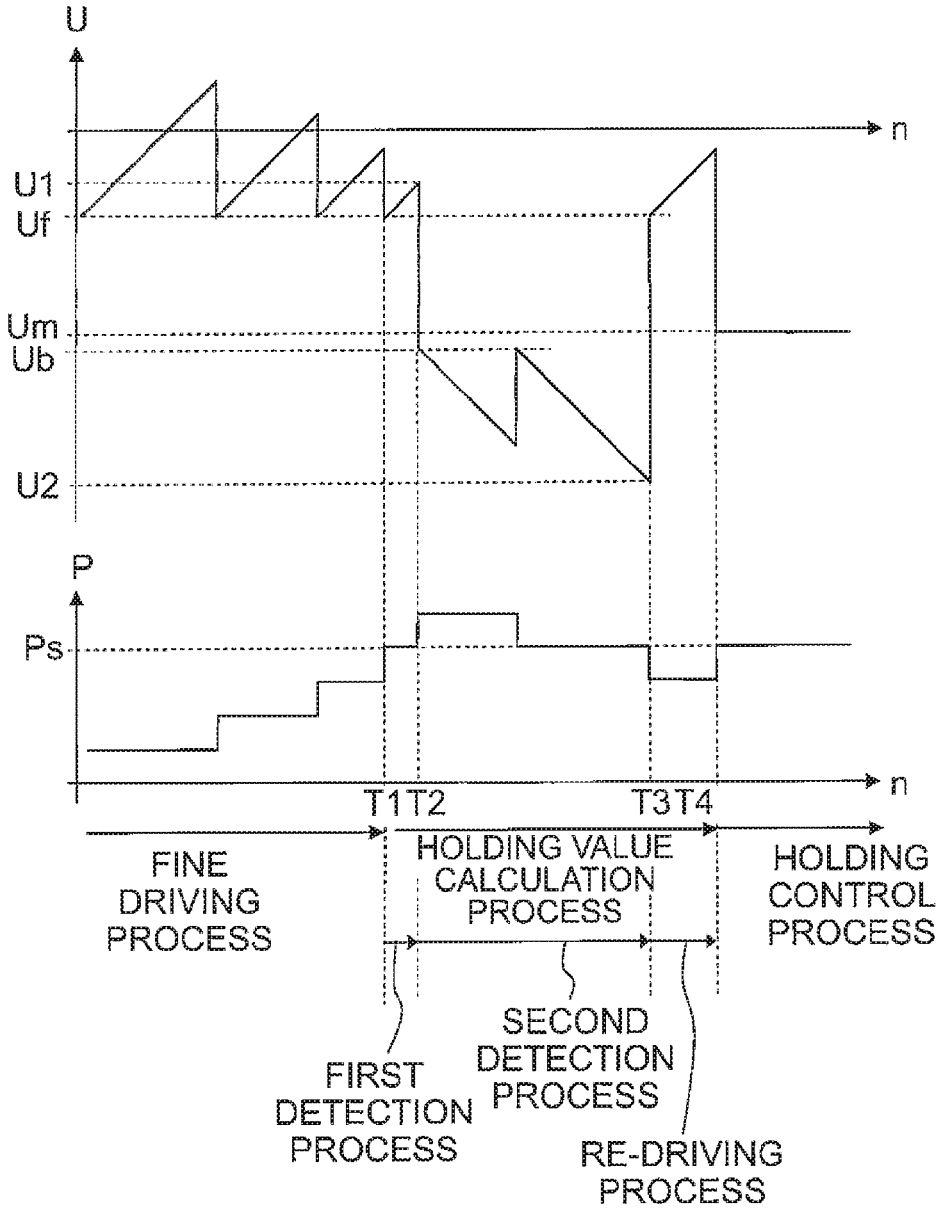
FIG. 6 is a graph group in which the change in an operation amount is shown in an upper section and the change in a position is shown in a lower section.

The upper graph of FIG. 6 schematically shows the change in the operation amount U corresponding to the driving current, which is to be inputted to the CR motor 81 when the carriage 71 in the maintenance area MA moves to a target stop position Ps in the first direction, with a time n as a horizontal axis. The lower graph of FIG. 6 schematically shows the change in the position P of the carriage 71, while corresponding to the change in the operation amount U shown in the upper graph of FIG. 6, with a time n as a horizontal axis. The time n shown in each of the upper and lower graphs is a time of which unit is a control period (sampling period) of the print controller 40. In this embodiment, the operation amount U of when the CR motor 81 applies the power in the first direction to the carriage 71 and the driving current of the CR motor 81 are shown by positive values. In this embodiment, aloud Fe works in the first direction. Thus, in order to counteract the load Fe, a negative value may be inputted, as the operation amount U, to the motor driving circuit 85, when the carriage 71 moves in the first direction.

As understood from FIG. 6, in this embodiment, in order to move the carriage 71 from an initial position to the target stop position Ps in the first direction, the print controller 40 restores the operation amount U to an initial value Uf or Ub every time the position P of the carriage 71 changes by value 1, and then inputs the operation amount U to the motor driving circuit 85 while gradually changing the operation amount U. Accordingly, the print controller 40 controls the input current for the CR motor 81 to gradually change the position P of the carriage 71 relative to the target stop position Ps.

The print controller 40 disposes the carriage 71 at the target stop position Ps after controlling the driving current to be inputted to the CR motor 81 so that the carriage 71 once passes the target stop position Ps in the first direction and the second direction.

Specifically, the print controller 40 controls the driving current to be inputted to the CR motor 81 until the position P of the carriage 71 changes by a value +1, namely, the print controller 40 controls the driving current to be inputted to the CR motor 81 so that the carriage 71 moves to a position (Ps+1) which is advanced in the first direction from the target stop position Ps by one unit. After that, the print controller 40 controls the driving current to be inputted to the CR motor 81 until the position P of the carriage 71 changes by a value −1, namely, the print controller 40 controls the driving current to be inputted to the CR motor 81 so that the carriage 71 moves from the position (Ps+1) to a position (Ps−1). Lastly, the print controller 40 controls the driving current to be inputted to the CR motor 81 so that the carriage 71 moves to the position Ps.

The print controller 40 determines a holding operation amount Um corresponding to the holding current value based on an operation amount U1 and an operation amount U2. The operation amount U1 is an operation amount immediately before the operation amount U is restored to the initial value Uf when the carriage 71 has passed through the target stop position Ps in the first direction. The operation amount U2 is an operation amount immediately before the operation amount U is restored to the initial value Uf when the carriage 71 has passed through the target stop position Ps in the second direction. The print controller 40 determines the holding operation amount Um corresponding to the holding current value as an average value (U1+U2)/2 of the operation amounts U1 and U2. The operation amount U1 corresponds to the operation amount U of when the carriage 71 has moved from the target stop position Ps in the first direction by one unit. The operation amount U2 corresponds to the operation amount U of when the carriage 71 has moved from the target stop position Ps in the second direction by one unit. Accordingly, the print controller 40 sets the holding current value close to the center of the current range which can hold the carriage 71 at the target stop position Ps, thereby improving the holding performance of the carriage 71.

Subsequently, a process which is executed by the print controller 40 to achieve the above operation will be explained in detail. When a movement command causing the carriage 71 to move from the home position in the first direction is inputted from the main controller 10, the print controller 40 repeatedly performs a periodic process shown in FIG. 7 with a predetermined control period to move the carriage 71 from the home position to the designated target stop position Ps in the first direction based on the movement command. Namely, the print controller 40 performs the periodic process per time n (n=0, 2, 3 . . . ) corresponding to the control period.

When the periodic process starts, the print controller 40 performs an input-output process (S110). The input-output process includes a step of inputting the operation amount U calculated most recently to the motor driving circuit 85 and a step of importing the position P of the carriage 71 detected by the signal processing circuit 95 as a current position P[h] of the carriage 71. When there is no operation amount U calculated most recently, a predetermined initial value can be inputted to the motor driving circuit 85. In the input-output process, the step of inputting the operation amount U to the motor driving circuit 85 may be performed first, and then the position P of the carriage 71 detected by the signal processing circuit 95 may be imported as the current position P[n] of the carriage 71.

After the input-output process, the print controller 40 judges whether or not a value of a flag FL2 is set to 1 (S120). All of the flags which will be described later have an initial value of zero. When the print controller 40 judges that the value of the flag FL2 is set to 1 (S120: Yes), the process proceeds to S180. When the print controller 40 judges that the value of the flag FL2 is not set to 1 (S120: No), the process proceeds to S130.

In S130, the print controller 40 judges whether or not a value of a flag FL1 is set to 1. When the print controller 40 judges that the value of the flag III is set to 1 (S130: Yes), the process proceeds to S170. When the print controller 40 judges that the value of the flag FL1 is not set to 1 (S130: No), the process proceeds to S140.

Figure 8:
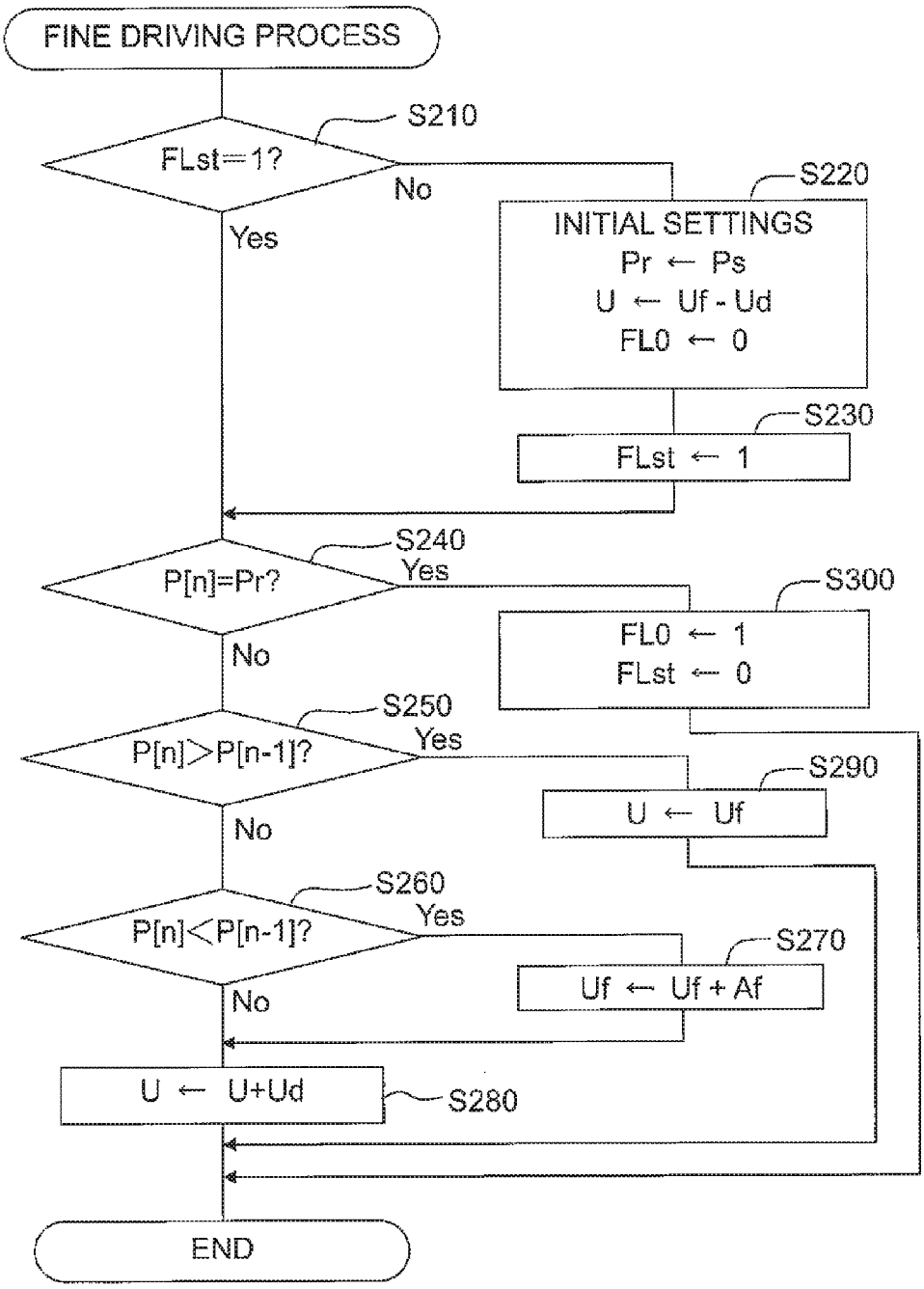
FIG. 8 is a flowchart showing a fine driving process executed by the print controller.

In S140, the print controller 40 performs a fine driving process shown in FIG. 8. In the fine driving process, the print controller 40 judges whether or not a value of a flag FLst is set to 1 (S210). When the print controller 40 judges that the value of the flag FLst is set to 1 (S210: Yes), the process proceeds to S240. When the print controller 40 judges that the value of the flag FLst is not set to 1 (S210: No), the process proceeds to S220.

Figure 9:
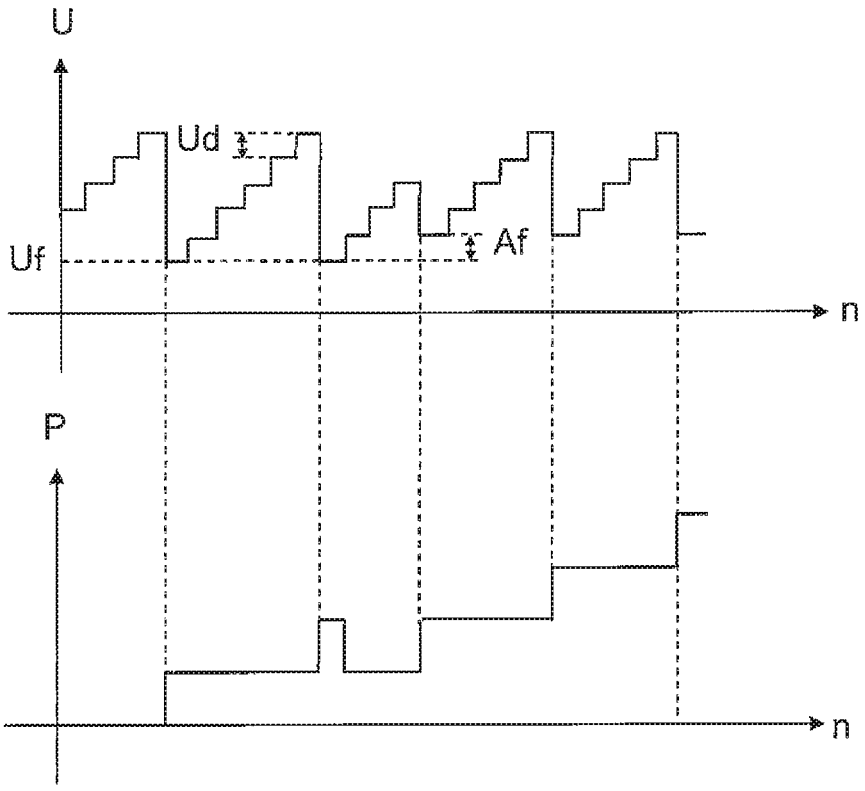
FIG. 9 is a graph group in which the change in an operation amount based on the fine driving process is shown in an upper section and the change in a position based on the fine driving process is shown in a lower section.

In S220, the printer controller 40 initializes various parameters relating to the fine driving process. Specifically, the print controller 40 sets a target position Pr to the target stop position Ps designated by the main controller 10. Further, the print controller 40 sets the operation amount U to a value (Uf−Ud) based on the initial value Uf for fine driving in the first direction and resets a value of a flag FL0 to zero. Here, the value Ud represents an amount of change per control period during which the operation amount U is gradually changed. In the following, the value Ud is to be referred to as a difference Ud. Although the change in the operation amount U during the fine driving process is schematically shown in a sawtooth-like shape in FIG. 6, the operation amount U actually changes in a step-like shape as shown in FIG. 9. The difference Ud corresponds to one step of the operation amount U changing stepwise. The operation amount U=Uf−Ud set in S220 is finally corrected by the value Ud in S280, and the corrected value is inputted as U=Uf to the motor driving circuit 85 in the input-output process (S110) to be performed in the next control period.

After S220, the print controller 40 sets the value of the flag FLst to 1 (S230) and the process proceeds to S240. Namely, the flag FLst is used to judge whether or not the process relating to the initial settings of various parameters for the fine driving process has been performed.

In S240, the print controller 40 judges whether or not the current position P[n] of the carriage 71 which has been imported from the signal processing circuit 95 in the input-output process (S110) matches or coincides with the target position Pr. When the print controller 40 judges that the current position P[n] does not match the target position Pr (S240: No), the process proceeds to S250.

In S250, the print controller 40 judges whether or not the current position P[n] is greater than the last or preceding position P[n−1]. That is, the print controller 40 judges whether or not the carriage 71 has been displaced by one unit in the first direction. When the print controller 40 judges that the current position P[n] is not more than the last position P[n−1] (S250: No), the process proceeds to S260.

In S260, the print controller 40 judges whether or not the current position P[n] is less than the last position P[n−1] (S260). That is, the print controller 40 judges whether or not the carriage 71 has been displaced by one unit in the second direction. When the print controller 40 judges that the current position P[n] is not less than the last position P[n−1] but the same as the last position P[n−1] (S260: No), the process proceeds to S280. In S280, the print controller 40 updates the operation amount U to a value (U+Ud) which is obtained by adding the difference Ud to the operation amount U, and then completes the fine driving process.

When the print controller 40 judges that the current position P[n] is less than the last position P[n−1] (S260: Yes), the print controller 40 judges that the initial value Uf is not appropriate and updates the initial value Uf to a value (Uf+Af) which is obtained by adding a predetermined amount Af to the current initial value Uf (S270). Since the initial value Uf is typically a negative value, the initial value Uf is corrected in a direction, in which the power (torque) of the CR motor 81 in the second direction is reduced, in this step. After that, the print controller 40 updates the operation amount U to the value (U+Ud) (S280) and completes the fine driving process.

In addition to the above, when the print controller 40 judges that the current position P[n] is greater than the last position P[n−1] (S250: Yes), the print controller 40 restores the operation amount U to the initial value Uf (S290) and completes the fine driving process.

When the print controller 40 judges that the current position P[n] matches the target position Pr (S240: Yes), the print controller 40 sets the value of the flag FL0 to 1 and resets the value of the flag FLst to zero (S300). After that, the print controller 40 completes the One driving process. After the printer controller 40 completes the fine driving process performed in S140, the process proceeds to S150 (see FIG. 7).

In S150, the print controller 40 judges whether or not the value of the flag FL0 is set to 1. When the print controller 40 judges that the value of the flag FL0 is set to 1 (S150: Yes), the print controller 40 sets the value of the flag FL1 to 1 (S160) and the process proceeds to S170. On the other hand, when the print controller 40 judges that the value of the flag FLU is not set to 1 (S150: No), the print controller 40 completes the periodic process. Performing the fine driving process (S140) in the periodic process changes the operation amount U stepwise as shown in FIG. 9, and thus the carriage 71 moves stepwise by one unit of the position P each.

Figure 10:
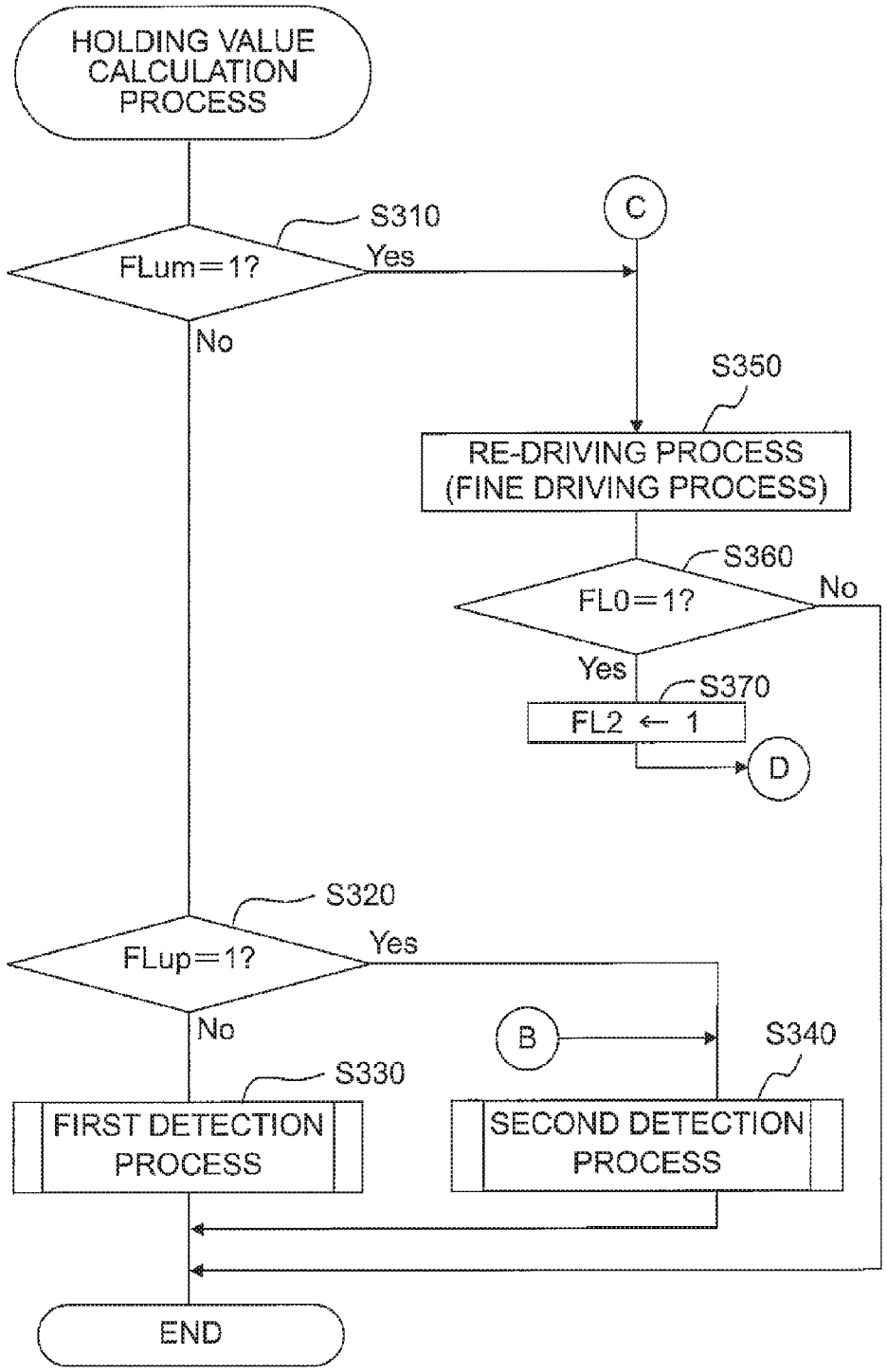
FIG. 10 is a flowchart showing a holding value calculation process executed by the print controller.

Next, an explanation will be made about a holding value calculation process performed by the print controller 40 in S170 with reference to FIG. 10. The holding value calculation process starts at a time T1 in FIG. 6. When the holding value calculation process starts, the print controller 40 judges whether or not a value of a flag FLum is set to 1 (S310). When the print controller 40 judges that the value of the flag FLum is set to 1 (S310: Yes), the process proceeds to S350. When the print controller 40 judges that the value of the flag FLum is not set to 1 (S310: No), the process proceeds to S320.

In S320, the print controller 40 judges whether or not a value of a flag FLup is set to 1. When the print controller 40 judges that the value of the flag FLup is set to 1 (S320: Yes), the process proceeds to S340. When the print controller 40 judges that the value of the flag FLup is not set to 1 (S320: No), the process proceeds to S330.

Figure 11:
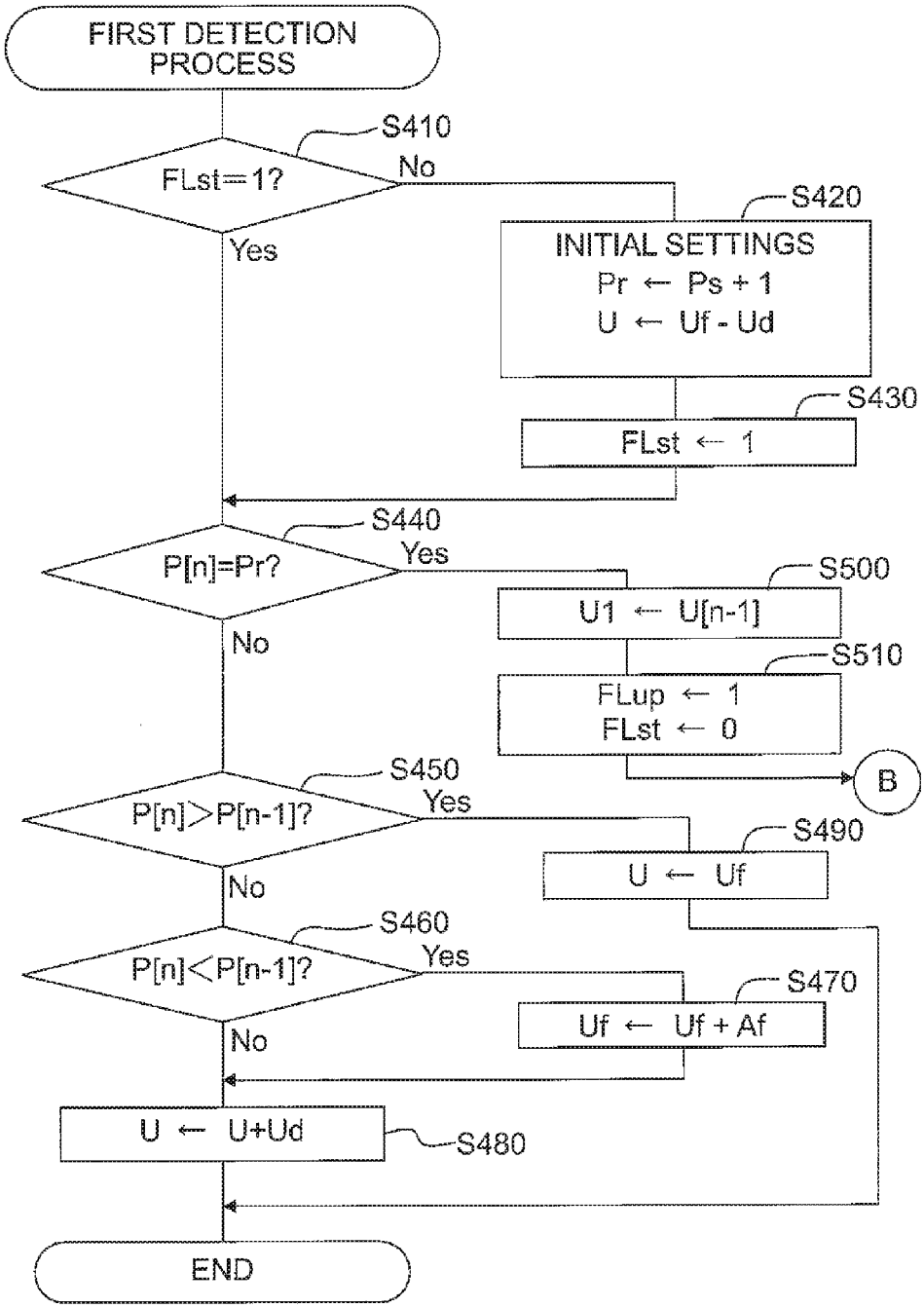
FIG. 11 is a flowchart showing a first detection process executed by the print controller.

In S330, the print controller 40 performs a first detection process shown in FIG. 11. The first detection process starts at the time T1 in FIG. 6. When the first detection process starts, the print controller 40 judges whether or not the value of the flag FLst is set to 1 (S410). When the print controller 40 judges that the value of the flag FLst is set to 1 (S410: Yes), the process proceeds to S440. When the print controller 40 judges that the value of the flag FLst is not set to 1 (S410: No), the process proceeds to S420.

In S420, the print controller 40 initializes various parameters relating to the first detection process. Specifically, the print controller 40 sets the target position Pr to a value Ps+1 which is greater than the target stop position Ps by 1. Namely, the target position Pr is set to a position which is advanced from the target stop position Ps by one unit in the first direction. Further, the print controller 40 sets the operation amount U to a value (Uf−Ud) based on the initial value Uf. The operation amount U=Uf−Ud set in S420 is corrected by the value Ud in S480 and the corrected value is inputted as U=Uf to the motor driving circuit 85 in the input-output process (S110) to be performed in the next control period. After S420, the print controller 40 sets the value of the flag FLst to 1 (S430) and the process proceeds to S440.

In S440, the print controller 40 judges whether or not the current position P[n] of the carriage 71 matches or coincides with the target position Pr. When the print controller 40 judges that the current position P[n] does not match the target position Pr (S440: No), the process proceeds to S450.

In S450, the print controller 40 judges whether or not the current position P[n] is greater than the last position P[n−1]. When the print controller 40 judges that the current position P[n] is not more than the last position P[n−1] (S450: No), the process proceeds to S460.

In S460, the print controller 40 judges whether or not the current position P[n] is less than the last position P[n−1]. When the print controller 40 judges that the current position P[n] is not less than the last position P[n−1] but the same as the last position P[n−1] (S460: No), the print controller 40 updates the operation amount U to a value (U+Ud) which is obtained by adding the difference Ud to the operation amount U (S480), and then completes the first detection process. After completing the first detection process, the print controller 40 completes the periodic process.

When the print controller 40 judges that the current position P[n] is less than the last position P[n−1] (S460: Yes), the print controller 40 updates the initial value Uf to a value (Uf+Af) which is obtained by adding a predetermined amount Af to the current initial value Uf (S470) After that, the print controller 40 updates the operation amount U to a value (U+Ud) (S480) and completes the first detection process.

In addition to the above, when the print controller 40 judges that the current position P[n] is greater than the last position P[n−1] (S450: Yes), the print controller 40 restores the operation amount U to the initial value Uf (S490) and completes the first detection process.

When the print controller 40 judges that the current position P[n] matches the target position Pr (S440: Yes), the process proceeds to S500. In S500, the print controller 40 sets an operation amount U[n−1], which has been inputted to the motor driving circuit 85 in the input-output process during this control period, as the operation amount U1. After that, the print controller 40 sets the value of the flag FLup to 1 and resets the value of the flag FLst to zero (S510). The flag FLup is used to judge whether or not the operation amount U1, which is used to determine the holding operation amount Um corresponding to the holding current value, has been set. After that, the process proceeds to S340 (see FIG. 10).

Figure 12:
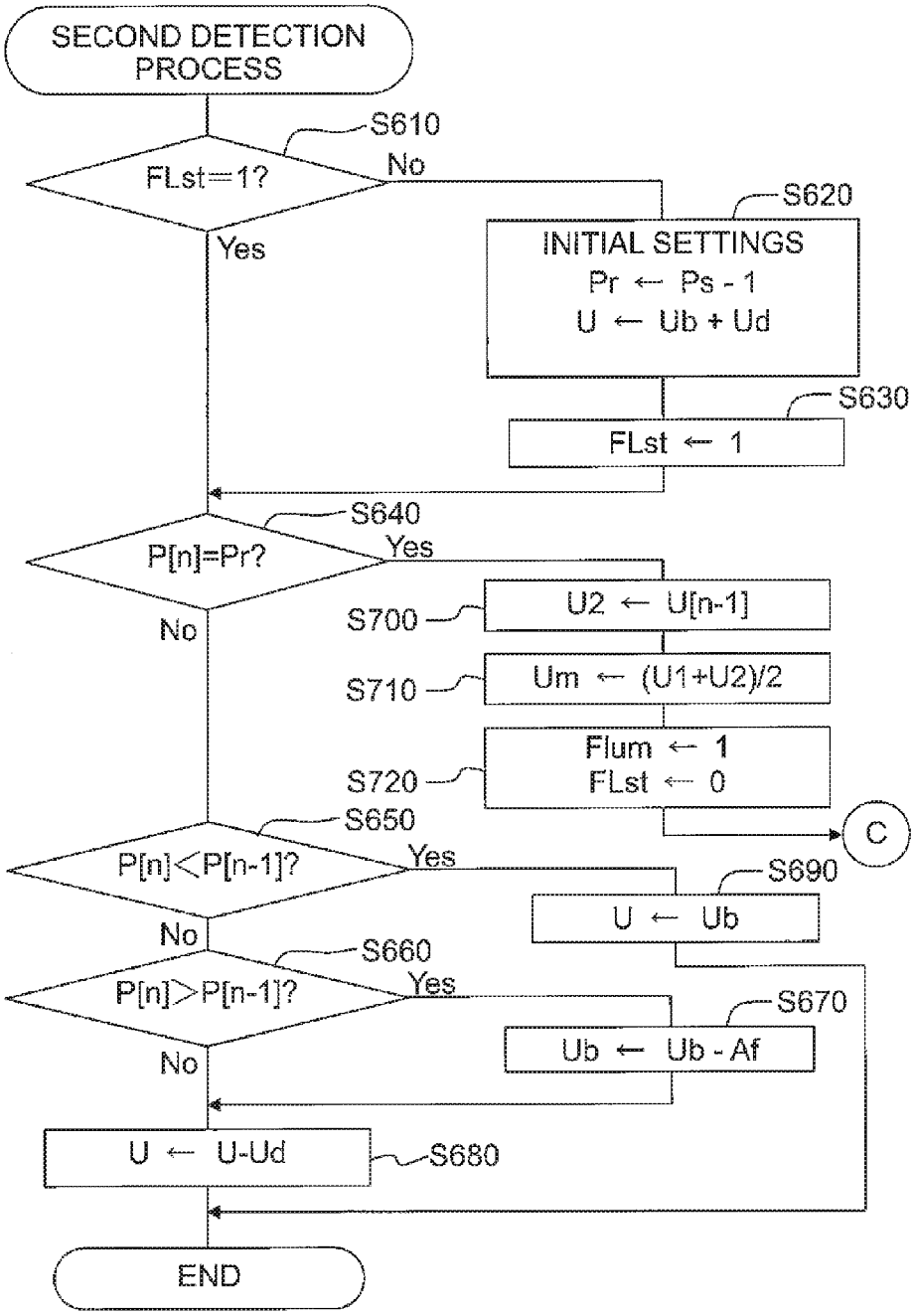
FIG. 12 is a flowchart showing a second detection process executed by the print controller.

In S340, the print controller 40 performs a second detection process shown in FIG. 12. The second detection process starts at a time T2 in FIG. 6. When the second detection process starts, the print controller 40 judges whether or not the value of the flag FLst is set to 1 (S610). When the print controller 40 judges that the value of the flag FLst is set to 1 (S610: Yes), the process proceeds to S640. When the print controller 40 judges that the value of the flag FLst is not set to 1 (S610: No), the process proceeds to S620.

In S620, the printer controller 40 initializes various parameters relating to the second detection process. Specifically, the print controller 40 sets the target position Pr to a value Ps−1 which is smaller than the target stop position Ps by 1. Namely, the target position Pr is set to a position which is advanced from the target stop position Ps in the second direction by one unit. Further, the print controller 40 sets the operation amount U to a value (Ub+Ud) based on an initial value Ub used for fine driving in the second direction. The operation amount U=Ub+Ud set in S620 is corrected by the value Ud in S680 and the corrected value is inputted as U=Ub to the motor driving circuit 85 in the input-output process (S110) to be performed in the next control period. After S620, the print controller 40 sets the value of the flag FLst to 1 (S630) and the process proceeds to S640.

In S640, the print controller 40 judges whether or not the current position P[n] of the carriage 71 matches or coincides with the target position Pr. When the print controller 40 judges that the current position P[n] does not match the target position Pr (S640: No), the process proceeds to S650.

In S650, the print controller 40 judges whether or not the current position P[n] is less than the last position P[n−1]. When the print controller 40 judges that the current position P[n] is not less than the last position P[n−1] (S650: No), the process proceeds to S660.

In S660, the print controller 40 judges whether or not the current position P[n] is greater than the last position P[n−1]. When the print controller 40 judges that the current position P[n] is not greater than the last position P[n−1] but the same as the last position P[n−1] (S660: No), the print controller 40 updates the operation amount U to a value (U−Ud) which is obtained by subtracting the difference Ud from the operation mount U (S680), and completes the second detection process. After the second detection process, the print controller 40 completes the periodic process.

When the print controller 40 judges that the current position P[n] is greater than the last position P[n−1] (S660: Yes), the print controller 40 updates the initial value Ub to a value (Ub−Af) which is obtained by subtracting a predetermined amount Af from the current initial value Ub (S670) After that, the print controller 40 updates the operation amount U to the value (U−Ud) (S680) and completes the second detection process.

In addition to the above, when the print controller 40 judges that the current position P[n] is less than the last position P[n−1] (S650: Yes), the print controller 40 restores the operation amount U to the initial value Ub (S490) and completes the second detection process.

When the print controller 40 judges that the current position P[n] matches the target position Pr (S640: Yes), the process proceeds to S700. In S700, the print controller 40 sets the operation amount U[n−1], which has been inputted to the motor driving circuit 85 in the input-output process during this control period, as the operation amount U2. After that, the print controller 40 sets the holding operation amount Um corresponding to the holding current value to an average value (U1+U2)/2 of the operation amount U1 set in S500 and the operation amount U2 set in S700 (S710).

Further, the print controller 40 sets the value of the flag FLum to 1 and resets the value of the flag FLst to zero (S720). The flag FLum is used to judge whether or not the holding operation amount Um corresponding to the holding current value has been set. After that, the process proceeds to S350 (see FIG. 10).

In S350, the print controller 40 performs a re-driving process. The re-driving process starts at a time 13 in FIG. 6. The re-driving process is basically the same as the fine driving process shown in FIG. 8. Namely, in the re-driving process, the print controller 40 performs a process for calculating the operation amount U to be used for fine driving of the carriage 71 to the target stop position Ps.

After the re-driving process, the print controller 40 judges in S360 whether or not the value of the flag FL0 is set to 1. When the position P[n] of the carriage 71 matches the target stop position Ps in the re-driving process, the value of the flag FL0 is set to 1 (S300). When the print controller 40 judges that the value of the flag FL0 is not set to 1 (S360: No), the print controller 40 completes the holding value calculation process and then completes the periodic process. When the print controller 40 judges that the value of the flag FL0 is set to 1 (S360: Yes), the print controller 40 sets the value of the flag FL2 to 1 (S370) and the process proceeds to S180 (see FIG. 7).

Figure 13:
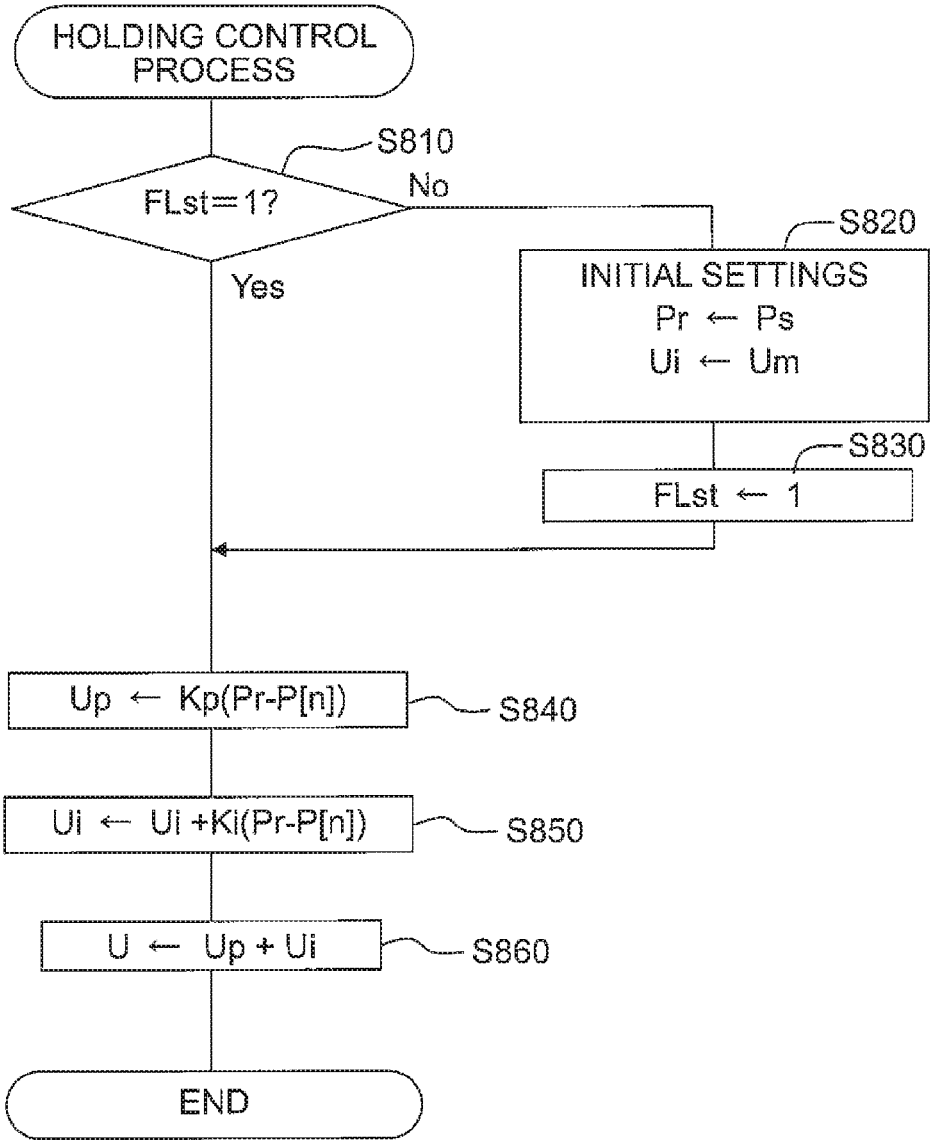
FIG. 13 is a flowchart showing a holding control process executed by the print controller.

In S180, the print controller 40 performs a holding control process shown in FIG. 13. The holding control process starts at a time T4 in FIG. 6. Although the print controller 40 calculates the operation amount U based on PI (proportional integral) control in the holding control process, the holding operation amount Um set in S710 is set as an initial value of this operation amount U.

When the holding control process starts, the print controller 40 judges whether or not the value of the flag FLst is set to 1 (S810). When the print controller 40 judges that the value of the flag FLst is set to 1 (S810: Yes), the process proceeds to S840. When the print controller 40 judges that the value of the flag FLst is not set to 1 (S810: No), the process proceeds to S820.

In S820, the printer controller 40 initializes various parameters relating to the holding control process. Specifically, the print controller 40 sets the target position Pr to the target stop position Ps. Further, the print controller 40 sets the holding operation amount Um set in S710 as an initial value of an operation amount Ui. The operation amount Ui corresponds to component I of the operation amount U for the CR motor 81. After S820, the print controller 40 sets the value of the flag FLst to 1 (S830) and the process proceeds to S840.

In S840, the print controller 40 sets an operation amount Up to a value Kp*(Pr−P[n]). Here, the value Kp is a predetermined proportional gain and the value P[n] is the current position of the carriage 71. The operation amount Up correspond to component P of the operation amount U for the CR motor 81.

After that, the process proceeds to S850 and the print controller 40 updates the operation amount Ui to a value which is obtained by adding the value Ki*(Pr−P[n]) to the current value in S850. The value Ki is a predetermined integral gain. Since the target position Pr, the target stop position Ps, and the current position P[n] are identical to each other in the control period in which S820 is executed, the operation amount Ui after the update in S850 is identical to the holding operation amount Um, and the operation amount Up set in S840 is zero.

After S850, the print controller 40 sets, as the operation amount U, a value (Up+Ui) which is obtained by adding the operation amount Up set in S840 to the operation amount Ui after the update in S850 (S860). After that, the print controller 40 completes the holding control process.

In the above description, the image forming system 1 of the first embodiment has been explained. As described above, the image forming system 1 of the first embodiment controls the driving current to be inputted to the CR motor 81 so that the carriage 71 passes the target stop position Ps in the first and second directions during the process in which the carriage 71 moves in the first direction to arrive at the target stop position Ps. The print controller 40 determines the holding operation amount Um based on the operation amounts U1 and U2. The operation amount U1 is inputted to the motor driving circuit 85 when the carriage 71 moves from the target stop position Ps in the first direction. The operation amount U2 is inputted to the motor driving circuit 85 when the carriage 71 moves from the target stop position Ps in the second direction.

Thus, according to the image forming system 1 of the first embodiment, the CR motor 81 applies, to the carriage 71, the power close to the center of the range which can hold the carriage 71, thereby making it possible to stably hold the carriage 71 at the target stop position Ps. Namely, the image forming system 1 of the first embodiment is less likely to lose the balance of power even in case of vibration or the like, and can hold the carriage 71 at the target stop position Ps while preventing the movement of the carriage 71 from the target stop position Ps.

To perform the flushing operation of the recording head 60, the following movement command may be inputted from the main controller 10. Namely, a flushing position, which is defined to be slightly separated from the origin P (P=0) in the first direction, is designated as the target stop position Ps. The reason why the flushing operation of the recording head 60 is performed in a state that the carriage 71 is separated from the origin P (P=0) as depicted in the center of FIG. 3 is as follows. Namely, if the cap 181 is too close to the nozzle surface of the recording head 60, splashes of ink droplets from the cap 181 dirty the nozzle surface of the recording head 60. The transmission mechanism 130 is configured to transmit power to the pump 170 when the carriage 71 is disposed at the flushing position. The pump 170 collects, from the cap 181, ink droplets discharged by the flushing operation. The pump 170 operates during the flushing operation to prevent ink droplets discharged by the flushing operation from leaking from the cap 181. That is, when the flushing operation of the recording head 60 is performed in the state that the carriage 71 is held in the flushing position, the vibration caused by the driving of the pump 170 changes static frictional force and/or external force acting on the carriage 71.

It is unfavorable to cause the situation in which the carriage 71 can not be held in the flushing position during the flushing operation. The image forming system 1 of the first embodiment can perform the flushing operation of the recording head 60 while stably holding the carriage 71 and the recording head 60 in the flushing position, and allows the pump 170 to collect ink droplets appropriately. Therefore, the first embodiment of the present teaching can provide the image forming system 1 with high performance to a user.

Especially, the image forming system 1 of the first embodiment sets the holding operation amount Um by specifying the operation amounts U1, U2 during the process in which the carriage 71 is disposed at the target stop position Ps. With this configuration, the holding operation amount Um can be set more appropriately while corresponding to the current state, as compared with a case in which the holding operation amount Um is set before the movement command. Accordingly, the carriage 71 of the image forming system 1 can be held with a higher degree of accuracy.

Further, the main controller 10 may designate, as the target stop position Ps, a first feed position or second feed position. The first feed position is a position of the carriage 71 where power is transmitted from the transmission mechanism 130 to the first feed unit 140. The second feed position is a position of the carriage 71 where power is transmitted from the transmission mechanism 130 to the second feed unit 150. The first and second feed positions each have a load acting on the carriage 71 different from that of the flashing position. The image forming system 1 of the first embodiment can appropriately set the holding operation amount Um also for each of the positions having the load different from that of the flushing position by taking the load into account in the periodic process. Thus, the carriage 71 of the image forming system 1 of the first embodiment can be held at the target stop position Ps much more stably than the case in which the holding current is uniform.

Second Embodiment

Figure 14:
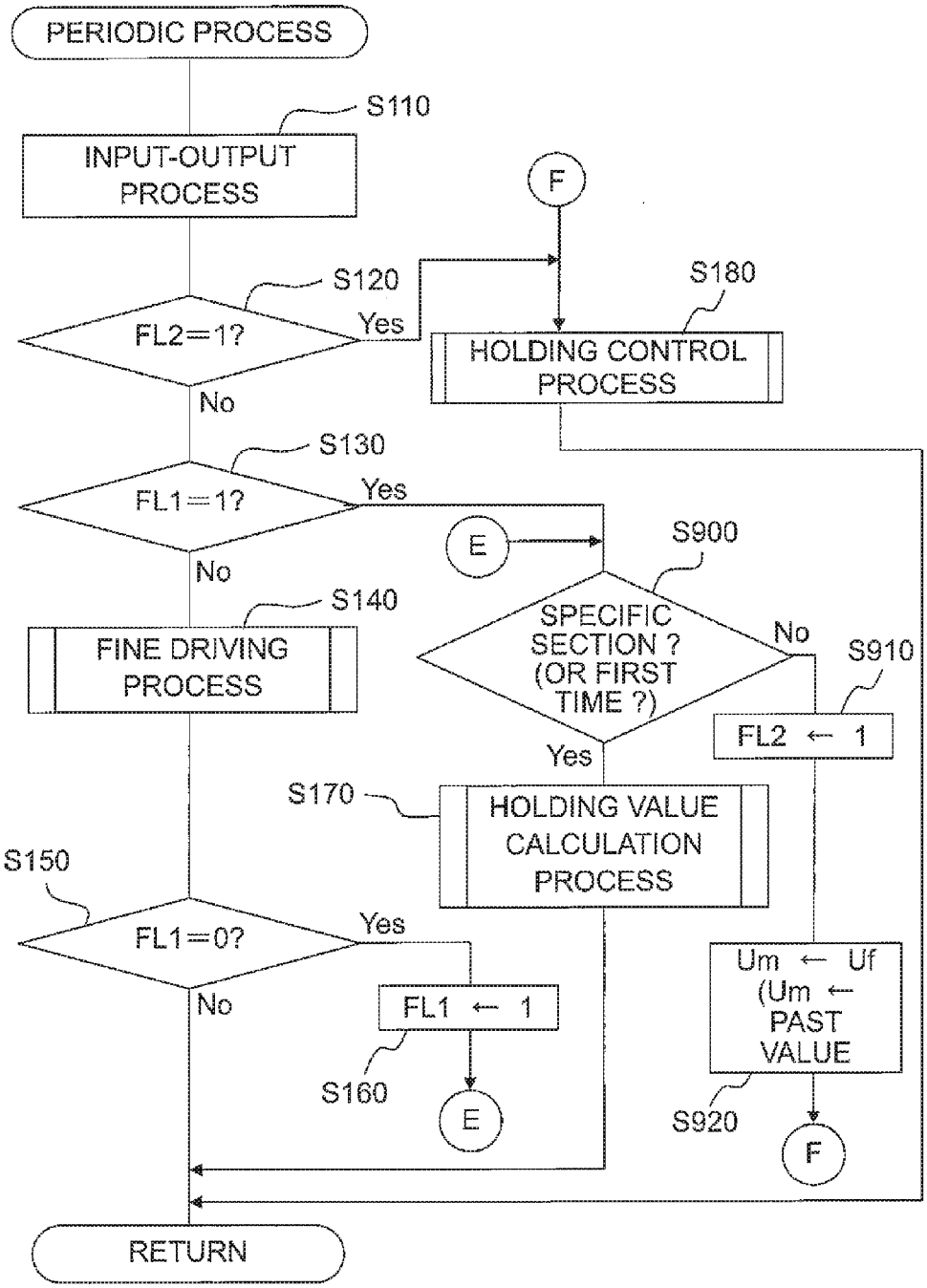
FIG. 14 is a flowchart showing a periodic process according to a second embodiment.

An explanation will be made about the image forming system 1 of the second embodiment. The image forming system 1 according to the second embodiment has basically the same configuration as that of the image forming system 1 according to the first embodiment, except that the print controller 40 performs a periodic process shown in FIG. 14 instead of the periodic process shown in FIG. 7. In the following, contents of the periodic process executed by the print controller 40 of the second embodiment will be explained selectively. Regarding steps of the periodic process in FIG. 14 which are designated by the same reference numerals as those of the periodic process in FIG. 7, the same processes as those of corresponding steps of the periodic process in FIG. 7 will be performed.

When the periodic process starts, the print controller 40 judges in S130 whether or not the value of the flag FL1 is set to 1. When the print controller 40 judges that the value of the flag FL1 is not set to 1 (S130: No), the process proceeds to S140. When the print controller 40 judges in S130 that the value of the flag FL1 is set to 1 (S130: Yes), the process proceeds to S900. Further, when the value of the flag FL1 is set to 1 in S160, the process proceeds to S900 as well.

In S900, the print controller 40 judges whether or not the target stop position Ps is in a specific section of the maintenance area MA. The specific section is a section, of the maintenance area MA, which has a great load fluctuation. For example, the specific section is defined to be a section ranging from the position P=Puc where the carriage 71 makes contact with or is separated from the capping unit 180 to the origin P=0 (see FIG. 4). In this section, the load acting on the carriage 71 greatly varies due to the contact between the carriage 71 and the capping unit 180 (more specifically, the wall 183A of the lift 183).

When the print controller 40 judges that the target stop position Ps is in the specific section (S900: Yes), the process proceeds to S170 and the print controller 40 performs the holding value calculation process in S170 in the similar manner as the first embodiment. After that, the print controller 40 performs subsequent processes in the similar manner as the first embodiment.

When the print controller 40 judges that the target stop position Ps is outside the specific section (S900: No), the print controller 40 sets the value of the flag FL2 to 1 (S910) and sets the holding operation amount Um to the value Uf (S920). Then, the process proceeds to S180. The processes performed by the print controller 40 in and after S180 are the same as those of the first embodiment, except that the holding operation amount Um of when the target stop position Ps is outside the specific area is different from that of the first embodiment.

Namely, when the target stop position Ps is outside the specific section, the image forming system 1 of the second embodiment sets the uniform operation amount Uf as the holding operation amount Urn without movement of the carriage 71 in which the carriage 71 passes through the target stop position Ps, and controls the CR motor 81 to hold the carriage 71 at the target stop position Ps by means of the uniform holding current value. When the target stop position Ps is in the specific section, the image forming system 1 of the second embodiment moves the carriage 71 in the similar manner as the first embodiment to set the holding operation amount Urn.

In the section outside the specific section which has no load, fluctuation or little load fluctuation, the image forming system 1 of the second embodiment can stably hold the carriage 71 at the target stop position Ps by inputting the holding current, which corresponds to the uniform holding operation amount Um=Uf, to the CR motor 81. In other words, unlike the specific section, there is no need to determine the holding operation amount Um. Since no holding value calculation process is performed, the carriage 71 can be disposed at the target stop position Ps quickly. Accordingly, the CR motor 81 and the carriage 71 of the image forming system 1 of the second embodiment can be controlled appropriately and efficiently depending on the target stop position Ps.

Third Embodiment

An explanation will be made about the image forming system 1 of the third embodiment. The image forming system 1 of the third embodiment has basically the same configuration as those of the image forming systems 1 according to the first and second embodiments, except that some of the processes executed by the print controller 40 are different from those of the first and second embodiments. In the following, contents of the processes executed by the print controller 40 of the third embodiment which are different from those of the first and second embodiments will be selectively explained.

Figure 15:
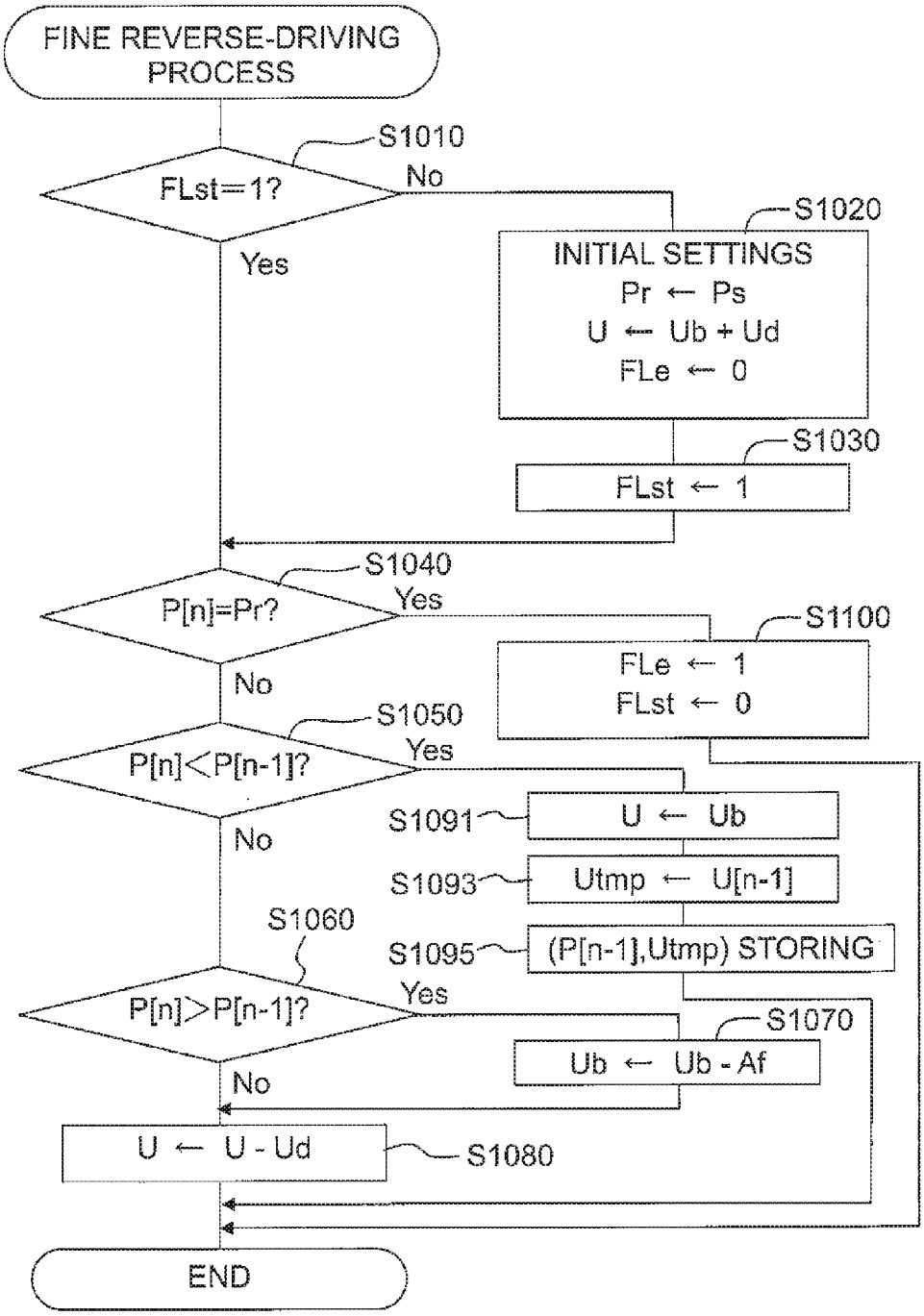
FIG. 15 is a flowchart showing a fine reverse-driving process executed by the print controller according to a third embodiment.

In the image forming system 1 of the third embodiment, when the main controller 10 inputs a movement command causing the carriage 71 to move to the home position, the print controller 40 repeatedly performs a fine reverse-driving process shown in FIG. 15 with a predetermined control period. Repeatedly performing the fine reverse-driving process by the print controller 40 moves the carriage 71 in the second direction to the origin P=0 as the target stop position Ps in the maintenance area MA.

In the fine reverse-driving process, the print controller 40 judges whether or not the value of the flag FLst is set to 1 (S1010). When the printer controller 40 judges that the value of the flag FLst is set to 1 (S1010: Yes), the process proceeds to S1040. When the printer controller 40 judges that the value of the flag FLst is not set to 1 (S1010: No), the process proceeds to S1020.

In S1020, the printer controller 40 initializes various parameters relating to the fine reverse-driving process. Specifically, the print controller 40 sets the target position Pr to the target stop position Ps. Further, the print controller 40 sets the operation amount U to the value (Ub+Ud) based on the initial value Ub used for fine driving in the second direction. Further, the print controller 40 resets a value of a flag FLe to zero. The operation amount U=Ub+Ud set in S1020 is corrected by the value Ud in S1080 and the corrected value is inputted as U=Ub to the motor driving circuit 85 in the input-output process (S110) to be performed in the next control period. After S1020, the print controller 40 sets the value of the flag FLst to 1 (S1030) and the process proceeds to S1040.

In S1040, the print controller 40 judges whether or not the current position P[n] of the carriage 71 which has been imported from the signal processing circuit 95 in the input-output process (S110) matches or coincides with the target position Pr. When the print controller 40 judges that the current position P[n] does not match the target position Pr (S1040: No), the process proceeds to S1050.

In S1050, the print controller 40 judges whether or not the current position P[n] is less than the last position P[n−1]. That is, the print controller 40 judges whether or not the carriage 71 has been displaced in the second direction by one unit. When the print controller 40 judges that the current position P[n] is not less than the last position P[n−1] (S1050: No), the process proceeds to S1060.

In S1060, the print controller 40 judges whether or not the current position P[n] is greater than the last position P[n−1] (S1060). That is, the print controller 40 judges whether or not the carriage 71 has been displaced in the first direction by one unit. When the print controller 40 judges that the current position P[n] is not greater than the last position P[n−1] but the same as the last position P[n−1] (S1060: No), the print controller 40 updates the operation amount U to the value (U−Ud) which is obtained by subtracting the difference Ud from the operation mount U (S1080), and completes the fine reverse-driving process.

When the print controller 40 judges that the current position P[n] is greater than the last position P[n−1] (S1060: Yes), the print controller 40 updates the initial value Ub to the value (Ub−Af) (S1070). After that, the print controller 40 updates the operation amount U to the value (U−Ud) (S1080) and completes the fine reverse-driving process.

In addition to the above, when the print controller 40 judges that the current position P[n] is less than the last position P[n−1] (S1050: Yes), the print controller 40 restores the operation amount U to the initial value Ub (S1091). Further, the print controller 40 sets the operation amount U[n−1], which has been inputted to the motor driving circuit 85 in the input-output process during this control period, as an operation amount Utmp (S1093). The print controller 40 correlates the operation amount Utmp with information of the last position P[n−1] and stores it (S1095). Then, the print controller 40 completes the fine reverse-driving process.

When the print controller 40 judges that the current position P[n] matches the target position Pr (S1040: Yes), the print controller 40 sets the value of the flag FLe to 1 and resets the value of the flag FLst to zero (S1100). After that, the print controller 40 completes the fine reverse-driving process. The print controller 40 repeatedly performs the fine reverse-driving process until the carriage 71 reaches the target position Pr (home position). A mechanism which mechanically holds the carriage 71 can be disposed at the home position which is the end or terminal of the carriage movement path.

Figure 16:
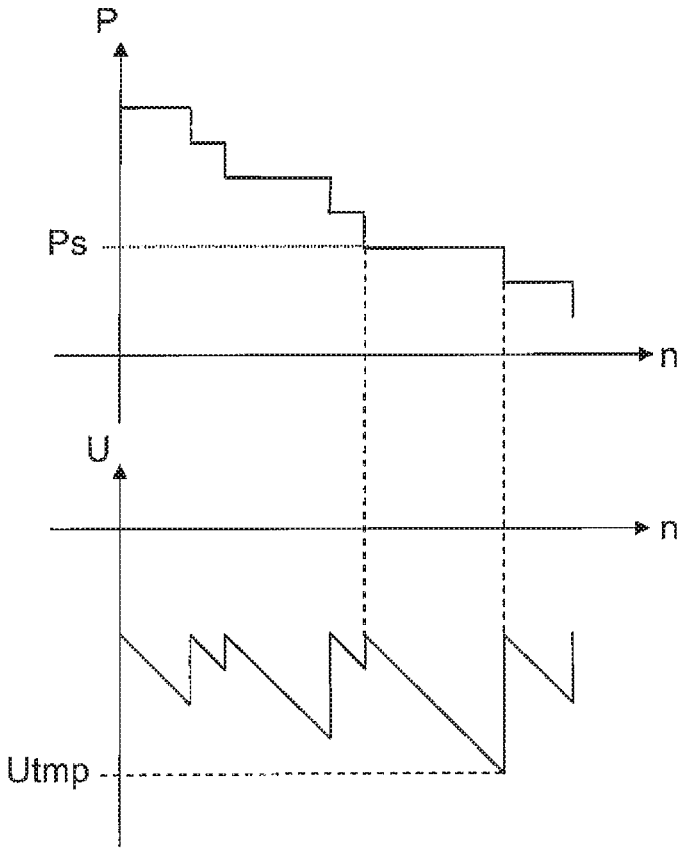
FIG. 16 is a graph group in which the change in a position based on the fine reverse-driving process is shown in an upper section and the change in an operation amount based on the fine reverse-driving process is shown in a lower section.

During the process in which the carriage 71 passes the maintenance area MA in the second direction to arrive at the home position, the print controller 40 stores the operation amount Utmp of when the carriage 71 passes each position P, which is a potential target stop position Ps, in the second direction. The operation amount Utmp is stored at all of the positions where the carriage 71 passes in the second direction in the fine reverse-driving process shown in FIG. 15. However, if the operation amount Utmp will not be used, there is no need to store it in S1095. FIG. 16 shows the operation amount Utmp of when the carriage 71 passes the position Ps in the second direction in the fine reverse-driving process.

Figure 7:
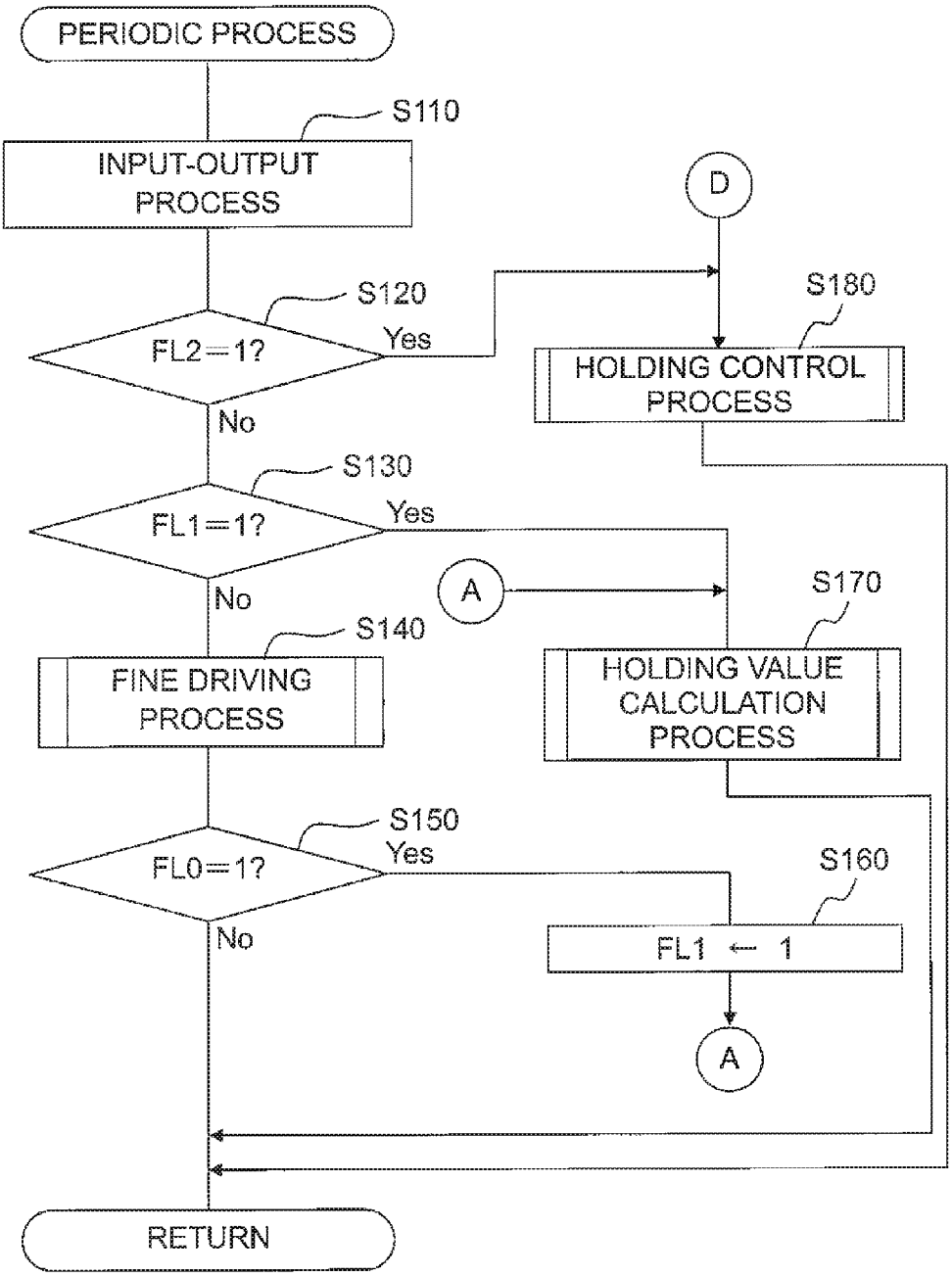
FIG. 7 is a flowchart showing a periodic process executed by a print controller.
Figure 17:
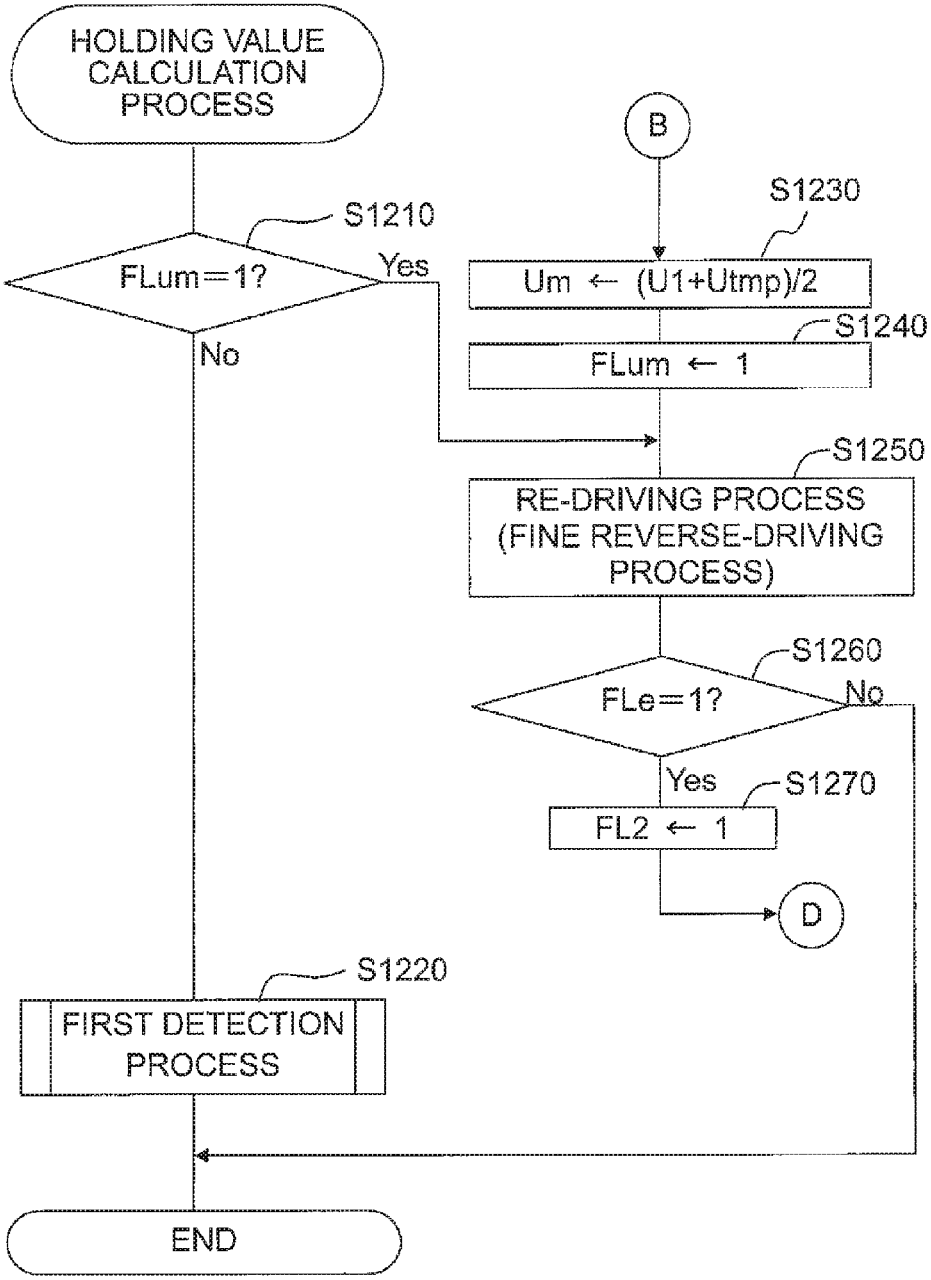
FIG. 17 is a flowchart showing a holding value calculation process according to the third embodiment.

When the main controller 10 inputs a movement command causing the carriage 71 to move from the home position in the first direction, the print controller 40 repeatedly performs the periodic process shown in FIG. 7. Then, in S170, the print controller 40 performs a holding value calculation process according to the third embodiment shown in FIG. 17. The holding value calculation process starts at a time T5 in FIG. 18.

When the holding value calculation process starts, the print controller 40 judges whether or not the value of the flag FLum is set to 1 (S1210). When the print controller 40 judges that the value of the flag FLum is set to 1 (S1210: Yes), the process proceeds to S1250. When the print controller 40 judges that the value of the flag FLum is not set to 1 (S1210: No), the process proceeds to S1220.

In S1220, the print controller 40 performs the first detection process shown in FIG. 11. The first detection process starts at the time T5 in FIG. 18. When the print controller 40 judges in S440 of the first detection process that the current position P[n] does not match the target position Pr (S440: No), the print controller 40 performs the process of S450 to S490 in the similar manner as the first embodiment. After the first detection process, the print controller 40 completes the periodic process.

When the print controller 40 judges in S440 that the current position P[n] matches the target position Pr (S440: Yes), the print controller 40 performs the process of S500 to S510 in the similar manner as the first embodiment. Then, the process proceeds to S1230 (see FIG. 17).

In S1230, the print controller 40 sets the holding operation amount Um to an average value (U1+Utmp)/2 of the operation amount U1 set in S500 and the operation amount Utmp which is previously stored in S1095 and which is correlated to the target stop position Ps in this process. The operation amount Utmp used in this process corresponds to the operation amount U immediately before the operation amount U is changed to the initial value Ub, the change of the operation amount U to the initial value Ub being caused by allowing the carriage 71 to pass the target stop position Ps so as to be displaced to the position (Ps−1) during the fine reverse-driving process repeatedly performed. After that, the print controller 40 sets the value of the flag FLum to 1 (S1240), and the process proceeds to S1250.

In S1250, the print controller 40 performs the re-driving process. The re-driving process starts at a time T6 in FIG. 18. The re-driving process is basically the same as the fine reverse-driving process shown in FIG. 15, except that the target position Pr set in S1020 of the re-driving process is the target stop position Ps designated by the movement command and S1093 and S1095 are not performed in the re-driving process. The print controller 40 calculates, in the re-driving process, the operation amount U for finely driving the carriage 71 to the designated target stop position Ps.

In the re-driving process, when the print controller 40 judges that the position P[n] of the carriage 71 matches the target stop position Ps, the value of the flag FLe is set to 1 (S1100). When the print controller 40 judges that the value of the flag FLe is not set to 1 (S1260: No), the print controller 40 completes the holding value calculation process and then completes the periodic process. When the print controller 40 judges that the value of the flag FLe is set to 1 (S1260: Yes), the value of flag FL2 is set to 1 (S1270) and the process proceeds to S180 (see FIG. 7). The processes, which are performed by the print controller 40 in and after S180, are the same as those of the first embodiment.

Figure 18:
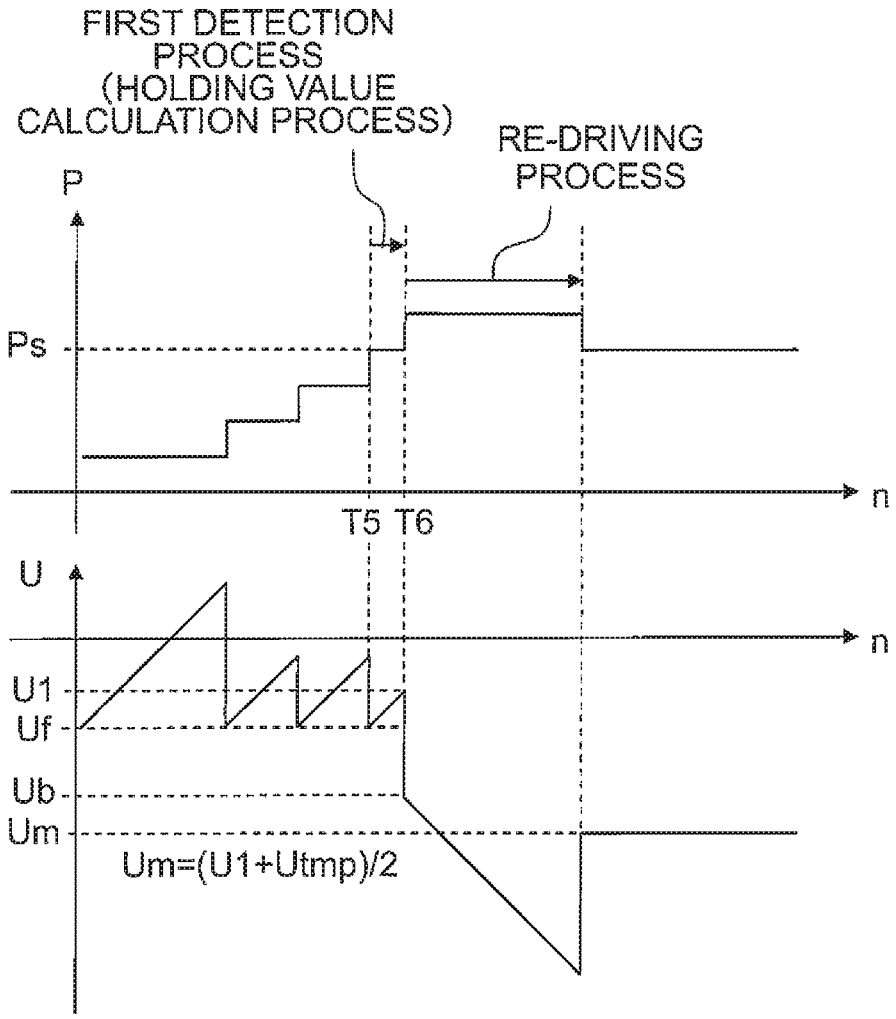
FIG. 18 is a graph group in which the change in a position based on a periodic process according to the third embodiment is shown in an upper section and the change in an operation amount based on the periodic process according to the third embodiment is shown in a lower section.

As described above, in the third embodiment, the operation amount Utmp, which takes the place of the operation amount U2 in the first embodiment, is obtained during the process in which the carriage 71 moves to the home position. Thus, as shown in FIG. 18, the carriage 71 according to the third embodiment can be disposed at the target stop position Ps efficiently. However, the image forming system 1 of the first embodiment may have the performance for holding the carriage 71 at the target stop position Ps superior to that of the image forming system 1 of the third embodiment.

OTHER EMBODIMENTS

In the above description, the explanation has been made about the embodiments of the present teaching. The present teaching, however, is not limited to the embodiments and the present teaching can adopt various aspects. In the above embodiments, the print controller 40 performs the P1 control in the holding control process. The print controller 40, however, may be configured to continue inputting the holding operation amount Um to the motor driving circuit 85 in the holding control process. Namely, the print controller 40 may be configured to continue inputting the uniform driving current, which corresponds to the holding operation amount Um, from the motor driving circuit 85 to the CR motor 81 in the holding control process.

In the above embodiments, the holding, operation amount Um is set by using the operation amounts U1, U2 of when the carriage 71 passes the target stop position Ps in the first and second directions. Each of the operation amounts U1, U2, however, may be an operation amount of when the carriage 71 passes a position adjacent to the target stop position Ps in each of the first and second directions. The holding operation amount Um can be set to an almost appropriate value even when the holding operation amount Um is set based on the operation amount U of when the carriage 71 passes the position adjacent to the target stop position Ps in each of the first and second directions, provided that no load changes sharply around the target stop position Ps. In the third embodiment, when the operation amount U, of when the carriage 71 passes the position (Ps−1) which is behind the target stop position Ps by one unit, is used as the operation amount U1, the almost appropriate holding operation amount Um can be set without control of the carriage 71 causing the carriage 71 to pass the target stop position Ps.

The print controller 40 may be configured to perform the holding value calculation process only when the carriage 71 is disposed at the target stop position Ps for the first time after the image forming system 1 is turned on. For example, the print controller 40 performs the same process as the periodic process shown in FIG. 14, and then may judge in S900 whether or not the movement command causing the carriage 71 to move to the target stop position Ps is the first command after the image forming system 1 is turned on. In this case, the print controller 40 may be configured to set, in S920, the holding operation amount Urn, which was set at the time of a previous movement command, as the holding operation amount Um for the process being executed.

The correspondence or correlation between the terms is as follows. The carriage 71 is an exemplary driving target. The carriage movement unit 70 is an exemplary driving unit. Each of the encoder 91 and the signal processing circuit 95 is an exemplary detection unit. The print controller 40 is an exemplary controller. The operation amount U is an exemplary input current value for a motor. The operation amount U1 is an exemplary first current value. Each of the operation amounts U2 and Utmp is an exemplary second current value. The holding operation amount Um is an exemplary holding current value. The initial value Uf is an exemplary first initial value. The initial value Ub is an exemplary second initial value. The cap 181, the lift 183, and the spring 185 are examples of a capping unit and a switching unit.

What is claimed is:

1. A control system, comprising:

a motor;

a driving unit including a driving target and being configured to displace or move the driving target in a first direction and a second direction opposite to the first direction by transmitting power from the motor to the driving target;

a detection unit configured to detect a position of the driving target; and a controller configured to control the motor, wherein the controller is configured to execute:

a displacement control process in which the controller controls an input current for the motor to displace the driving target in the first direction and the second direction;

a determination process in which the controller determines a holding current value holding the driving target at a target stop position; and a holding control process in which the controller controls the input current for the motor based on the holding current value determined by the determination process to hold the driving target, which has been disposed at the target stop position in the displacement control process, at the target stop position, wherein, in the displacement control process, the controller gradually changes: a first initial value of the input current so that the power acting on the driving target increases in the first direction every time the position of the driving target detected by the detection unit is displaced in the first direction, in a case that the driving target is displaced in the first direction; and a second initial value of the input current so that the power acting on the driving target increases in the second direction every time the position of the driving target detected by the detection unit is displaced in the second direction, in a case that the driving target is displaced in the second direction; and in the determination process, the controller determines the holding current value based on a first current value and a second current value, the first current value being a value of the input current which is controlled in the displacement control process, in which the driving target passes a target area including the target stop position in the first direction, to change the position of the driving target in the first direction, the second current value being a value of the input current which is controlled in the displacement control process, in which the driving target passes the target area in the second direction, to change the position of the driving target in the second direction.

2. The control system according to claim 1, wherein the displacement control process, which is executed by the controller to dispose the driving target at the target stop position, includes a first step in which the controller controls the input current to allow the driving target to pass the target area in the first direction and a second step in which the controller controls the input current to dispose the driving target at the target stop position after the first step, and in the determination process, the controller determines the holding current value by using, as the first current value, a current value obtained in the first step.

3. The control system according to claim 2, wherein the second step includes:

a backward movement control step in which the controller controls the input current to allow the driving target to pass the target area in the second direction; and a disposition step in which the controller controls the input current to displace the driving target in the first direction and to dispose the driving target at the target stop position after the backward movement control step, and in the determination process, the controller determines the holding current value by using, as the second current value, a current value obtained in the backward movement control step.

4. The control system according to claim 3, wherein the target area is an area between a first position and a second position, the first position being separated from the target stop position in the first direction by a first predetermined amount, the second position being separated from the target stop position in the second direction by a second predetermined amount; and the controller is configured to:

control the input current to displace the driving target from an initial position to the first position in the first direction in the first step;

control the input current to displace the driving target from the first position to the second position in the backward movement control step; and control the input current to displace the driving target, which has been displaced to the second position in the backward movement control step, in the first direction by the second predetermined amount and to dispose the driving target at the target stop position in the disposition step.

5. The control system according to claim 4, wherein the first predetermined amount is identical to the second predetermined amount.

6. The control system according to claim 2, wherein the controller executes the first step and the second step only in a case that the driving target is disposed at the target stop position for the first time after the control system is turned on.

7. The control system according to claim 1, wherein a displacement area of the driving unit includes a load change section where magnitude of a load acting on the driving target changes; and in a case that the target stop position is in the load change section, the controller executes the determination process to determine the holding current value holding the driving target at the target stop position within the load change section.

8. The control system according to claim 7, wherein in the load change section, the load acting on the driving target decreases every time the driving target is displaced in the first direction and the load acting on the driving target increases every time the driving target is displaced in the second direction.

9. The control system according to claim 1, wherein the first current value corresponds to a value of an input current which is controlled in a case that the position of the driving target detected by the detection unit is shifted from the target stop position in the first direction by one unit, and the second current value corresponds to a value of an input current which is controlled in a case that the position of the driving target detected by the detection unit is shifted from the target stop position in the second direction by one unit.

10. The control system according to claim 1, wherein the controller determines the holding current value to an average value of the first current value and the second current value in the determination process.

11. The control system according to claim 1, wherein the controller holds the driving target at the target stop position by maintaining the input current for the motor at the holding current value in the holding control process.

12. The control system according to claim 1, wherein the controller controls the input current for the motor by PI (proportional integral) control and holds the driving target at the target stop position in the holding control process, the PI control being based on a deviation between the target stop position and the position of the driving target detected by the detection unit and using the holding current value as an initial value.

13. An image forming system comprising:

the control system as defined in claim 1 including a movement unit and the controller, the movement unit being configured, as the driving unit, to move a recording head on a sheet due to action of power from the motor to form an image on the sheet, the controller being configured to control the motor to control a position of the recording head, wherein a switching unit, which is configured to switch an operation state of the image forming system based on the position of the recording head, is disposed on a terminal area of a movement path of the recording head in which the recording head moves during the displacement control process.

14. The image forming system according to claim 13, wherein the recording head is an ink-jet head, and the switching unit includes a capping unit configured to move a cap, which covers an ink discharge surface of the ink-jet head, toward the ink discharge surface in a case that the ink-jet head moves in one of the first direction and the second direction and configured to move the cap in a direction away from the ink discharge surface in a case that the ink-jet head moves in the other of the first direction and the second direction.

* * * * *